US011625987B2

(12) United States Patent
Moskowitz et al.

(10) Patent No.: US 11,625,987 B2
(45) Date of Patent: Apr. 11, 2023

(54) SYSTEMS AND METHODS FOR GENERATION OF VIRTUAL SPORTING EVENTS

(71) Applicant: Fayble, LLC, Oakland, CA (US)

(72) Inventors: Alan S. Moskowitz, Oakland, CA (US); Bidit Acharya, Oakland, CA (US); Matthew Benjamin Naranjo, Morgan Hill, CA (US); Susan Elizabeth Wilson, San Diego, CA (US)

(73) Assignee: FAYBLE, LLC, Oakland, CA (US)

( * ) Notice: Subject to any disclaimer, the term of this patent is extended or adjusted under 35 U.S.C. 154(b) by 149 days.

(21) Appl. No.: 16/817,344

(22) Filed: Mar. 12, 2020

(65) Prior Publication Data

US 2020/0294365 A1 Sep. 17, 2020

Related U.S. Application Data

(60) Provisional application No. 62/817,398, filed on Mar. 12, 2019.

(51) Int. Cl.
*G07F 17/32* (2006.01)
*G06Q 50/34* (2012.01)

(52) U.S. Cl.
CPC ..... *G07F 17/3288* (2013.01); *G06Q 50/34* (2013.01); *G07F 17/3223* (2013.01)

(58) Field of Classification Search
CPC ..... G07F 17/3223; G07F 17/3288; G06Q 50/34
See application file for complete search history.

(56) References Cited

U.S. PATENT DOCUMENTS

2002/0177483 A1* 11/2002 Cannon ..... G07F 17/32 463/16
2008/0070666 A1* 3/2008 Gatto ..... G07F 17/3234 463/16
2016/0054865 A1* 2/2016 Kerr ..... H04W 12/041 715/739
2018/0132011 A1* 5/2018 Shichman ..... G11B 27/28

* cited by examiner

*Primary Examiner* — Werner G Garner
(74) *Attorney, Agent, or Firm* — Kwan & Olynick LLP

(57) ABSTRACT

Provided are systems and processes for generating virtual sporting events. An example method comprises obtaining reference content data comprising reference video, audio, and statistics of a plurality of original sporting events. The reference content is segmented into a plurality of event segments which are identified based on predefined milestones and comprises corresponding video data segments, audio data segments, and statistical play data. The event segments are classified with one or more categories based on the corresponding data and the event segment information is stored. An event segment is selected as a virtual event segment for each time segment of the virtual sporting event based on various predetermined criteria. The virtual event segments are desensitized by at least partially removing color and sound. Virtual event data is mapped to each of the virtual event segments and virtual event information is generated based on the progress of the virtual sporting event.

18 Claims, 14 Drawing Sheets

SYSTEMS AND METHODS FOR GENERATION OF VIRTUAL SPORTING EVENTS

CROSS-REFERENCE TO RELATED APPLICATIONS

This application claims priority under 35 U.S.C. § 119(e) to U.S. Provisional Application No. 62/817,398, filed Mar. 12, 2019, entitled SYSTEMS AND METHODS FOR GENERATION OF VIRTUAL SPORTING EVENTS, the contents of which are hereby incorporated by reference.

TECHNICAL FIELD

The present disclosure relates to a system and associated methods of audio and video content processing. In one example, the present disclosure relates to generation of virtual sporting events.

BACKGROUND

Virtual sporting events have been rapidly gaining popularity among several industries. Fantasy sports is a type of entertainment involving imaginary or virtual teams assembled from real players of a professional sport, which compete based on the statistical performance of those players in actual games. This performance is converted into points that are compiled and totaled according to selected rosters, which may be compiled and calculated using computers tracking actual results of the professional sport. Esports (also known as electronic sports, e-sports, or eSports) is a form of competition using video games, most commonly taking the form of organized, multiplayer video game competitions, particularly between professional players and teams. Such multiplayer video games often involve competitions of professional sports, such as basketball, soccer, and baseball, featuring fictional players and real players from the corresponding professional sport.

Revenue may be generated from broadcasting, advertising, wage placement, and other fees for managing leagues, scoring, and user accounts. As such, it is desirable to provide new forms of virtual sporting events based on actual and fictional sports and athletes.

SUMMARY

The following presents a simplified summary of the disclosure in order to provide a basic understanding of certain embodiments of this disclosure. This summary is not an extensive overview of the disclosure, and it does not identify key and critical elements of the present disclosure or delineate the scope of the present disclosure. Its sole purpose is to present some concepts disclosed herein in a simplified form as a prelude to the more detailed description that is presented later.

Provided are various mechanisms and processes for generating virtual sporting events. In one aspect, which may include at least a portion of the subject matter of any of the preceding and/or following examples and aspects, a method for generating a virtual sporting event comprises obtaining reference content data from a content database. The reference content data comprises reference video, reference audio, and reference statistics of a plurality of original sporting events. The reference audio and the reference statistics correspond to the reference video.

The method further comprises segmenting the reference content data into a plurality of event segments. The plurality of event segments is identified based on one or more predefined milestones and comprises corresponding video data segments from the reference video, audio data segments from the reference audio, and statistical play data from the reference statistics. The method further comprises classifying the event segments with one or more categories based on the portion of reference content data corresponding to the event segments, and storing event segment information in a segments database.

The method further comprises selecting one or more event segments from the segment database as a virtual event segment for each time segment of the virtual sporting event. The method further comprises desensitizing each of the virtual event segments by at least partially removing color and sound from each of the virtual event segments. The method further comprises mapping virtual event data to each of the virtual event segments. The virtual event data comprises one or more selected from the group consisting of: virtual event audio and fictional character information. The method further comprises generating virtual event information for the virtual sporting event based on the mapped virtual event data and the progress of the virtual sporting event indicated by the virtual event segments.

The one or more predefined milestones may be identified based on graphical information displayed in the reference video. Classifying the event segments with one or more categories may include, for each event segment, assigning tags to the event segment based on one or more of the following: a type of play included in the first event segment, a crowd sentiment based on the reference audio associated with the first event segment, success of a play included in the first event segment, and one or more players involved in a play included in the first event segment.

In some embodiments, selecting one or more event segments from the segment database as a virtual event segment for each time segment of the virtual sporting event comprises receiving historical play data corresponding one or more historical sporting events and determining probabilities of occurrence for different play types at different progress points based on the historical play data. Then for each time segment, a current virtual event information may be determined based on virtual event segments selected for previous time segments, a set of valid event segments is identified based on the current virtual event information, and a new event segment of the set of valid event segments is selected as the virtual event segment for the time segment based on the probabilities of occurrence, wherein the new event segment includes a category corresponding to a play type of the different play type.

In some embodiments, selecting one or more event segments from the segment database as a virtual event segment for each time segment of the virtual sporting event comprises receiving a programmed objective including one or more predetermined conditions, and determining the current virtual event information based on virtual event segments selected for previous time segments. Then for each time segment, current virtual event information may be determined based on virtual event segments selected for previous time segments, and whether the predetermined condition is satisfied is determined. If the predetermined condition is satisfied, a new event segment of the set of valid event segments is selected as the virtual event segment based the programmed objective, wherein the new event segment includes a category that satisfies the programmed objective.

In some embodiments, selecting one or more event segments from the segment database as a virtual event segment for each time segment of the virtual sporting event comprises generating a set of complete virtual sporting events, wherein each complete sporting event comprises a possible combination of event segments. A first complete virtual sporting event is selected from the set of complete virtual sporting events; and the one or more event segments corresponding to the first complete virtual sporting event are selected.

The method may further comprise displaying the desensitized virtual event segments in conjunction with associated virtual event data and virtual event information. The method may further comprise obtaining narrative audio corresponding to the desensitized virtual event segments and corresponding virtual event data and creating a virtual event audio file. The virtual event audio file may include non-interactive audio including the narrative audio and corresponding virtual event audio.

The method may further comprise transmitting the virtual event audio file to a plurality of client devices associated with a plurality of audience members. Transmitting the virtual event audio file may comprise transmitting the virtual event audio file via a network. In some embodiments, selecting one or more event segments from the segment database as a virtual event segment for each time segment of the virtual sporting event comprises obtaining audience feedback data from the plurality of client devices associated with the plurality of audience members, wherein the audience feedback data indicates a desired category. An event segment including a category corresponding to the desired category is then selected.

Other implementations of this disclosure include corresponding devices, systems, and computer programs, and associated methods for generating a virtual sporting event. These other implementations may each optionally include one or more of the following features. For instance, provided is a server system configured to generate a virtual sporting event, which comprises one or more processors, memory, and one or more programs stored in the memory. The one or programs comprise instructions for implementing the described method.

These and other examples are described further below with reference to the figures.

DETAILED DESCRIPTION

Figure 1:
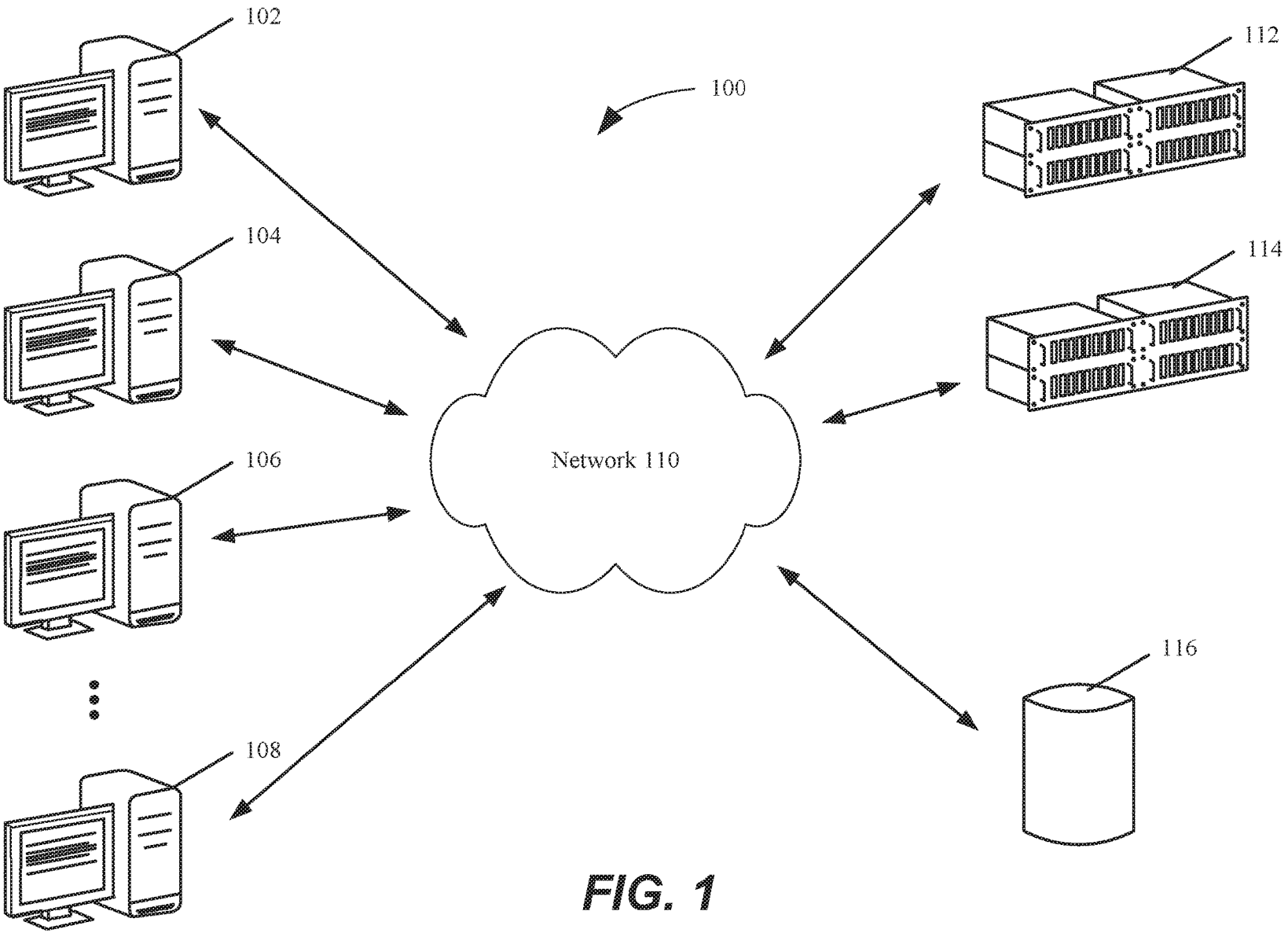
FIG. 1 is an example network architecture for implementing various systems and methods of the present disclosure, in accordance with one or more embodiments.

In the following description, numerous specific details are set forth in order to provide a thorough understanding of the presented concepts. The presented concepts may be practiced without some or all of these specific details. In other instances, well known process operations have not been described in detail so as to not unnecessarily obscure the described concepts. While some concepts will be described in conjunction with the specific examples, it will be understood that these examples are not intended to be limiting. On the contrary, it is intended to cover alternatives, modifications, and equivalents as may be included within the spirit and scope of the present disclosure as defined by the appended claims.

In the following description, numerous specific details are set forth in order to provide a thorough understanding of the present disclosure. Particular embodiments of the present disclosure may be implemented without some or all of these specific details. In other instances, well known process operations have not been described in detail in order not to unnecessarily obscure the present disclosure.

For example, the techniques of the present invention may be described in the context of various sporting events, such as football games, baseball games, basketball games, etc. However, it should be noted that the techniques of the present invention may also be applied to audio or video content for various other types of virtual events, such fictional stories or literary events, computer gaming or electronic sports, etc. The techniques of the present invention may be described in the context of particular protocols, such as Wi-Fi or Bluetooth. However, it should be noted that the techniques of the present invention may also be applied to variations of protocols. In the following description, numerous specific details are set forth in order to provide a thorough understanding of the present invention. Particular example embodiments of the present invention may be implemented without some or all of these specific details. In other instances, well known process operations have not been described in detail in order not to unnecessarily obscure the present invention.

Various techniques and mechanisms of the present invention will sometimes be described in singular form for clarity. However, it should be noted that some embodiments include multiple iterations of a technique or multiple instantiations of a mechanism unless noted otherwise. For example, a system uses a processor in a variety of contexts. However, it will be appreciated that a system can use multiple processors while remaining within the scope of the present invention unless otherwise noted. Furthermore, the techniques and mechanisms of the present invention will sometimes describe a connection between two entities. It should be noted that a connection between two entities does not necessarily mean a direct, unimpeded connection, as a variety of other entities may reside between the two entities. For example, a processor may be connected to memory, but it will be appreciated that a variety of bridges and controllers may reside between the processor and memory. Consequently, a connection does not necessarily mean a direct, unimpeded connection unless otherwise noted.

Overview

The systems and methods described herein can be implemented to generate virtual sporting events. Reference content data corresponding to original sporting events may be segmented into a plurality of event segments. The reference content data may comprise reference video, reference audio, and reference statistics corresponding to the original sporting events. The event segments may be identified based on various milestones in the original sporting events, such as the beginning of each down in a football game, each pitch in a baseball game, or every one minute period in a basketball game. Each event segment may comprise corresponding video data segments from the reference video, audio data segments from the reference audio, and statistical play data from the reference statistics.

Each event segment may be classified with one or more categories. Various characteristics of each event segment may be identified based on the corresponding video segments, audio segments, and statistical play data. The event segments may then be associated with one or more categories based on the identified characteristics. Event segment information may be stored in a segment database. In some embodiments, this may be a table level distributed database system. The event segment information may comprise mark-in and/or mark-out points of each event segment in corresponding reference content data, as well as classified categories for each event segment.

A virtual sporting event may comprise one or more consecutive time segments. One or more event segments are selected as a virtual event segment for each time segment based on a combination of various segment selection methods. In some embodiments, event segments may be selected at random. In some embodiments, a virtual coach or virtual team method may select event segments based on estimated probabilities of occurrence of different plays based on historical event data corresponding to particular teams or coaches. In some embodiments, a principled play selection method may select event segments based on various programmed objectives. In some embodiments, an interactive play selection method may select event segments based on user input received from various client devices. In some embodiments, an exhaustive play selection method may select event segments by generating a set of various complete virtual sporting events and selecting the event segments comprising a complete virtual sporting event that is selected based on desired outcomes.

The selected virtual event segments may then be desensitized by at least partially removing color and sound from the corresponding video data segments and audio data segments. Virtual event data may be mapped to the virtual event segments. Virtual event data may comprise virtual event audio and fictional character information. For example, virtual event audio may be mapped to a particular virtual event segment based on the identified characteristics or classified categories associated with the virtual event segment. As another example, fictional character information corresponding to players on a fictional team may be mapped to the players in a virtual event segment.

Virtual event audio may then be created based on the generated virtual sporting event. The virtual event audio may comprise narrative audio. The desensitized virtual event segments may be displayed at a user interface in conjunction with associated virtual event data and virtual event information. The virtual sporting event may be viewed by a user, such as an announcer. The announcer may create narrative audio based on the viewing, which may be recorded. The virtual event audio may also incorporate the virtual event audio with the narrative audio. The narrative audio and virtual event audio may be considered non-interactive audio. The virtual event audio may be transmitted to a plurality of client devices associated with a plurality of audience members.

In some embodiments, interactive audio may be generated based on input received from audience members. For example, the system may prompt audience members for selection inputs for particular sounds. As another example, audio input, such as cheers or jeers, may be recorded at client devices. Interactive audio may then be created from such audience input and combined with the non-interactive audio for real-time or near real-time transmission to the client devices corresponding to the audience members.

In some embodiments, game manipulation techniques may be implemented on the original sporting event. Various audience input may be received to influence various outcomes by influencing the probabilities of which event segments are selected as virtual event segments for various time segments. As such, the outcome of an original sporting event may be biased by audience interaction.

Example Embodiments

With reference to FIG. 1, shown is an example network architecture 100 for implementing various systems and methods of the present disclosure, in accordance with one or more embodiments. The network architecture 100 includes a number of client devices 102-108 communicably connected to one or more server systems 112 and 114 by a network 110.

In some embodiments, server systems 112 and 114 include one or more processors and memory. The processors of server systems 112 and 114 execute computer instructions (e.g., network computer program code) stored in the memory to perform functions of a network data exchange server. In various embodiments, the functions of the network data exchange server may include generating virtual sporting events with corresponding audio and video content and/or transmitting the corresponding audio and video content to one or more client devices.

In some embodiments, server system 112 is a content server configured to receive, process, and store content and information. In some embodiments server system 114 is a dispatch server configured to transmit and/or route network data packets including network messages. In some embodiments, content server 112 and dispatch server 114 are configured as a single server system that is configured to perform the operations of both servers. In some embodiments, various functions of server systems 112 and 114 may be divided among additional other server or sub-server systems.

In some embodiments, the network architecture 100 may further include a database 116 communicably connected to client devices 102-108 and server systems 112 and 114 via network 110. In some embodiments, network data, or other information such as user information, user input, and device information may be stored in and/or retrieved from database 116. In some embodiments, the server systems described herein may include databases, such as database 116, as integrated components to function as memory for storage.

Users of the client devices 102-108 access the server system 112 to participate in a network data exchange service. For example, the client devices 102-108 can execute web browser applications that can be used to access the network data exchange service. In another example, the client devices 102-108 can execute software applications that are specific to the network (e.g., networking data exchange "apps" running on smartphones).

Users interacting with the client devices 102-108 can participate in the network data exchange service provided by the server system 112 by distributing digital content, such as text comments (e.g., updates, announcements, replies), audio files, digital photos, videos, online orders, payment information, activity updates, location information, or other appropriate electronic information. In some implementations, information can be posted on a user's behalf by systems and/or services external to the network or the server system 112. For example, the user may transmit audio or video content to a program broadcasting website, and with proper permissions that website may cross-post the audio or video content to the network on the user's behalf. In another example, a software application executed on a mobile device, with proper permissions, may use global positioning system (GPS) capabilities to determine the user's location and automatically update the network with his location (e.g., "At Home", "At Work", "In San Francisco, Calif.").

In some implementations, the client devices 102-108 can be computing devices such as laptop or desktop computers, smartphones, personal digital assistants, portable media players, tablet computers, or other appropriate computing devices that can be used to communicate with an electronic social network. In some implementations, the server system 112 can include one or more computing devices such as a computer server. In various embodiments, a client device may correspond to a user such as an administrator or developer that uses the client device for generation of a virtual sporting event In some implementations, the server system 112 can represent more than one computing device working together to perform the actions of a server computer (e.g., cloud computing). In some implementations, the network 110 can be a public communication network (e.g., the Internet, cellular data network, dial up modems over a telephone network) or a private communications network (e.g., private LAN, leased lines).

Virtual Event Systems

Figure 2:
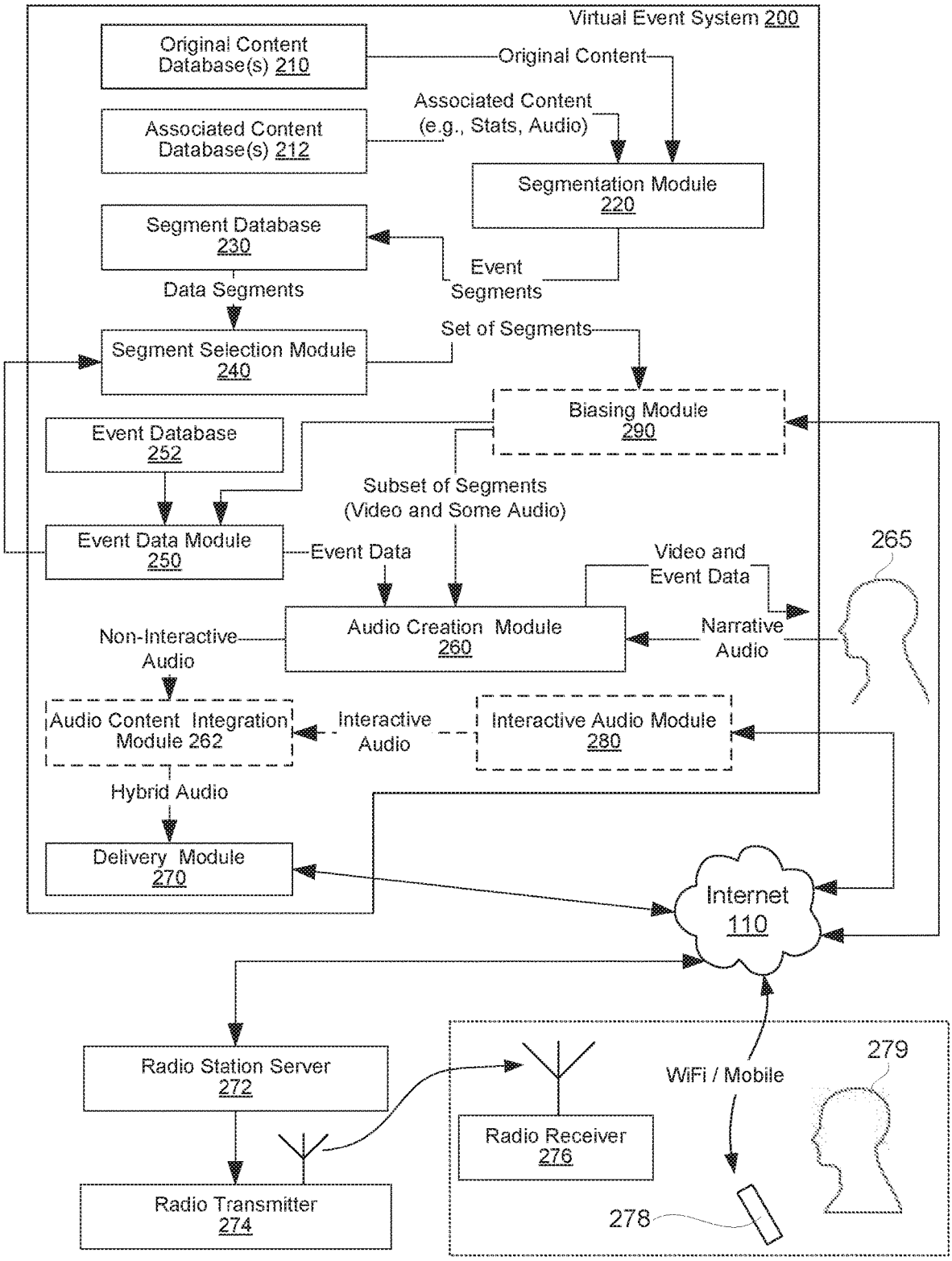
FIG. 2 is an example virtual event system for generating virtual sporting events, in accordance with one or more embodiments.

With reference to FIG. 2, shown is an example virtual event system 200 for generating virtual sporting events, in accordance with one or more embodiments. In various embodiments, virtual event system 200 may be a combination of one or more of server systems 112 and 114, and database 116, described within system architecture 100. In various embodiments, virtual event system 200 comprises original content database 210, associated content database 212, segmentation module 220, segment database 230, segment selection module 240, event data module 250, event database 252, audio creation module 260, audio content integration module 262, delivery module 270, and interactive audio module 280.

In some embodiments, each module within virtual event system 200 may be implemented as a separate server system or configured as a single server system in virtual event system 200 that is configured to perform the operations of all modules. Similarly, each database within virtual event system 200 may be implemented as a separate database or configured as a single database system that is configured to perform the operations of all databases. One or more methods described herein may be discussed with reference to FIG. 2.

Figure 3A:
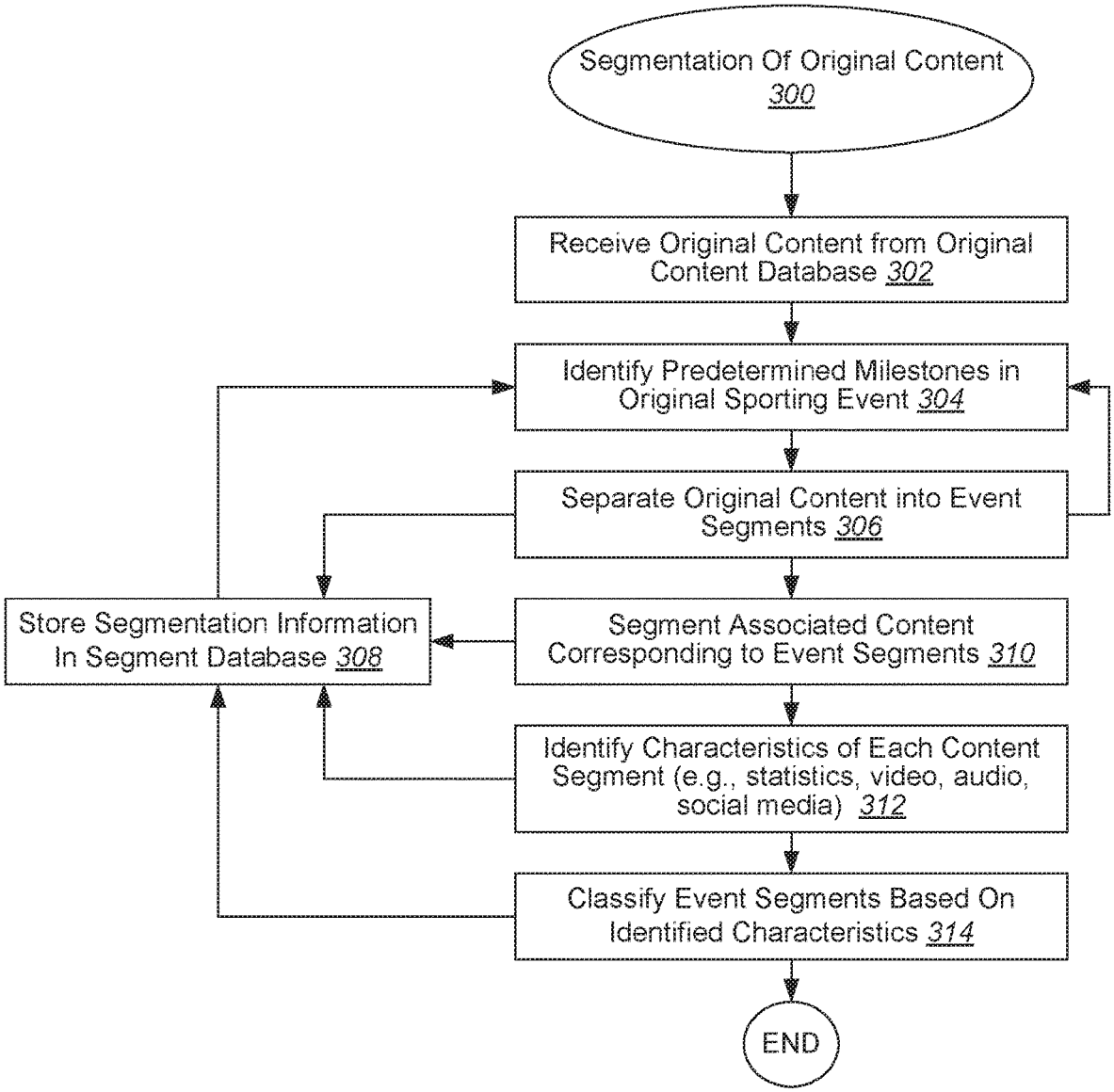
FIG. 3A illustrates an example method for segmenting original content data, in accordance with one or more embodiments.

With reference to FIG. 3A, shown is an example method 300 for segmenting original content data, in accordance with one or more embodiments. Method 300 may be implemented by one or more servers of virtual event system, such as segmentation module 220. At 302, original content is received from an original content database, such as original content database 210. Segmentation module 220 may also receive associated content data along with or separately from the original content.

In various embodiments, original content database 210 stores original content including audio and video content data associated with one or more original sporting events. In various embodiments, the original sporting events may be games, matches, or competitions of any one of various known sports, such as American football, soccer, baseball, basketball, hockey, tennis, golf, etc. Other popular sporting events may include Olympic events, cycling, foot races, skating, skiing, etc.

Such original content data may be content associated with live or recorded coverage of an original sporting event that is broadcast over television, radio, or other broadcasting media, such as the internet. For example, the original sporting event may be a professional football game, and the original content includes the original televised program of the original sporting event. In some embodiments, the original content data comprises audio and video of the recorded coverage. In some embodiments, original content data includes only the video footage of the original sporting event.

The original content may correspond with associated content, such as various other footage of the sporting event, sounds from the field, player sounds, crowd or spectator sounds, sounds from game officials or referees, commentary from a sports announcer or sportscaster, etc. Such associated content may be original content that has been extracted or separately recorded. Associated content may further include statistical play data corresponding to the original sporting event. For example, each play or down of a football game stored in original content database 210 may include statistical data for each player involved in such play, including player information, running yards, passing yards, total yards gained or lost, play type, tackles, down information, etc. Such statistics may be obtained from various entities, such as third-party vendors specializing in determining and recording game statistics. In some embodiments, statistics may also be derived from audio and video of the original content.

In some embodiments, the associated content may correspond to the original content based on various time positions or other chronological measurements or markers. For example, the original content data may comprise a true time corresponding to the actual real world time the original content was recorded or broadcast. The original content may also comprise a run time corresponding to the length of the video or audio of the original content data file. The original content may additionally, or alternatively, comprise a clock time corresponding to an in-game clock or timer for the recorded event. The associated content may also be associated with a corresponding actual time, clock time, or run time.

Such associated content data corresponding to the original content may be stored in associated content database 212. In some embodiments, associated content database 212 is separate from original content database 210. However, in some embodiments, original content database 210 and associated content database 212 are configured as a single database system that is configured to perform the operations of both databases. The original content and the associated content may be stored in any one of various types of video file formats, such as Audio Video Interleave (AVI), Flash Video Format (FLV), Windows Media Video (WMV), Apple QuickTime Movie (MOV), and Moving Pictures Expert Group 4 (MP4). However, it should be recognized that the original and associated content may comprise various other file formats.

Segmentation of Original Content Data

The segmentation module 220 may be implemented to separate the original content and associated content, into event segments. Each event segment of an original sporting event may be separated based on predetermined milestones. For example, predetermined milestones in a football game may be each down, and each event segment of a football game may comprise an interval between the beginning of a down to the beginning of the next down. As another example, each event segment of a baseball game may be each at bat. Each event segment of a baseball game may alternatively be each pitch thrown by a pitcher. As another example, each segment of a basketball game may comprise a predetermined interval of clock time.

At 304, predetermined milestones in the original sporting event are identified. Various techniques may be implemented to identify the predetermined milestones for different types of sporting events. For example, the predetermined milestones for the football game may be identified based on optical character recognition (OCR) of information shown within the video of the original content. As previously described, event segments of a football game may be marked by the start and end of a play or down. The number of the down and required yardage is typically identified on a graphical information panel in the video of a broadcasted or recorded football game. Segmentation module 220 may be configured to detect when the number of the down or yardage changes using OCR techniques and mark the particular time position of the original content for segmentation. As another example, notifications of a penalty or score on the graphical information panel may also be displayed and recognized via OCR techniques to indicate a segmentation location.

In some embodiments, OCR techniques may be implemented to identify the clock time, which is also typically graphically displayed on the original video content of an original sporting event. For example, event segments in a basketball game may be indicated by a predetermined clock time interval, which may be determined based on OCR identification of the displayed clock time for the particular game. In some embodiments, OCR techniques may be implemented to recognize text of closed caption data of the original sporting event. For example, dialogue and commentary by sports broadcasters regarding the original sporting event may be displayed as closed caption text on the video of the original content.

In some embodiments, milestones may be determined based on statistical play data. For example, statistical play data may record the time position (actual time, run time, or clock time) of each down in a football game. This data may be used by segmentation module 220 to identify and mark the time positions corresponding to the milestones in the original content or associated content for segmentation.

In some embodiments, motion detection may be implemented to identify the predetermined milestones of a sporting event. For example, the start or end of each down in the football game may be identified based on motion detection in the video. Generally, each down or play begins with relatively little or no movement by the players. As such, segmentation module 220 may be configured to detect motion within the video of the original content and identify the beginning of a play or down based on the lack of motion in the video.

In some embodiments, audio recognition of various audio and sounds in the original content may be implemented to identify the predetermined milestones. For example, a whistle sound from the referee typically signals the end of each down, penalty, or other event, in a football game. Thus, segmentation module 220 may be configured to detect particular sounds and audio, and mark the original content for segmentation at each time position a whistle sound is detected.

Figure 3B:
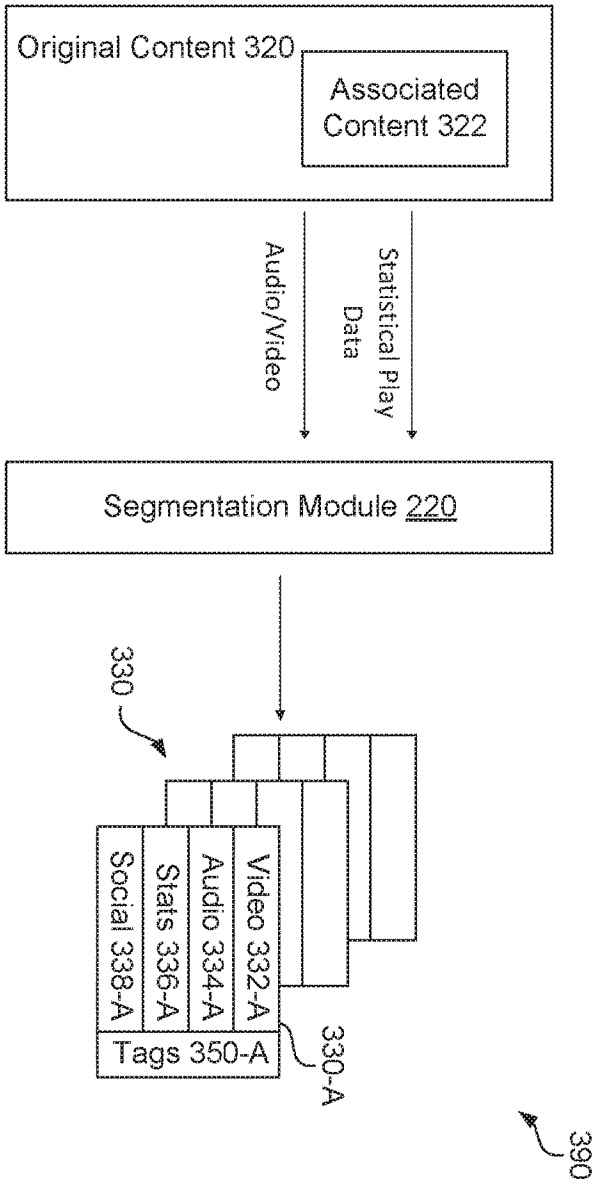
FIG. 3B illustrates a process flow for segmentation of original content by segmentation module, in accordance with one or more embodiments.

At operation 306, the original content is separated into event segments based on the predetermined milestones. With reference to FIG. 3B, shown is a flow process 390 for segmentation of original content 320 by segmentation module 220, in accordance with one or more embodiments. As an example, original content 320 may be a recording of a televised football game. As previously described, original content 320 may include associated content 322. Original content may comprise audio data and video data, and associated content 322 may comprise supplemental audio and video data, as well as statistical play data.

In various embodiments, segmentation module 220 separates original content 320 into one or more event segments 330 by marking the beginning and end of each event segment 330 in the original content based on the milestones identified at operation 304. The time position in the original content at which each identified milestone occurs may be recorded. The time position at which a milestone occurs may be recorded as a mark-in point corresponding to the beginning of an event segment. Additionally, or alternatively, the time position at which a milestone occurs may be recorded as a mark-out point corresponding to the end of an event segment. In various embodiments, the mark-in point or the mark-out point may correspond to the particular actual time, clock time, or run time of the original content.

As such, segmentation information including the mark-in point and/or mark-out point of each event segment is stored in a segment database at operation 308, such as segment database 230. In some embodiments, segment database 230 may be a table level distributed database system. In some embodiments, the mark-in point and/or mark-out point of each event segment is stored as metadata associated with the original content data.

Thus, the event segments 330 may comprise a segmented video component and a segmented audio component. As illustrated, exemplary event segment 330-A of event segments 330 comprises video segment 332-A and audio segment 334-A. In some embodiments, the audio and video data of original content 320 may be integrated in a single file format. However, in some embodiments, the audio and video data of original content 320 may be separate data files.

In such embodiments, separate audio and video data files may be synched and unified prior to the identification of milestones and separation into event segments. In some embodiments, the video data may be processed at operations 304 and 306 to identify the position of event segments. Such segments may then be identified in the audio data based on the time positions of mark-in points or mark-out points identified in the corresponding video data after synching the audio and video data files.

In various embodiments, one or more of operations 304, 306, and 308 may be repeated with additional analysis and processing of the original content data to unify data and refine the identification of the mark-in or mark-out points of the event segments. In the example of a football game, OCR techniques may be first used to identify the number of the down for each play indicated by a graphical information panel in the original content at 304. The mark-in point for each down may then be determined based on the OCR information at 306 and stored in the segment database at 308. Although OCR techniques may be accurate in reading the text of the graphical information panel, the indication of the down number may not accurately correspond with the exact start and end of the play corresponding to the indicated down. However, OCR identification may utilize relatively less processing power than other segment identification techniques, and may be first used to process the entire length of the original content of a game to identify the approximate mark-in point of each event segment in the original content.

Next, motion detection techniques may then be used to further pinpoint when each play starts or ends. In some embodiments, motion detection techniques may require relatively more processing power, but may be more accurate in determining the start of a play. As such, the motion detection may be implemented only on portions of the original content, such as during the 5 seconds before and 5 seconds after the mark-in point corresponding to each change in down number previously determined by OCR. The segmentation module may then adjust or update the mark-in or mark-out points of the event segments accordingly in the segmentation database. Thus, event segments may be more accurately identified using less overall processing power and time. It should be recognized that various video and audio processing techniques may be more suited to identify event segments for different sporting events. In some embodiments, operations 304 and 306 may be performed multiple times before the segmentation information is stored at operation 308. In such embodiments, the segmentation information may be temporarily stored in temporary operational memory, such as in Random Access Memory (RAM), before being permanently stored in the segment database.

In certain embodiments, separating the original content into event segments at operation 306 further comprises extracting the identified event segments from the original content. Various video and audio processing techniques may be implemented to extract the identified event segments from the original content at operation 306. In some embodiments, the audio and video of the identified event segment is copied as an event segment file. In some embodiments, other associated content corresponding to the event segment, such as game statistics, are also copied to the event segment file. In some embodiments, the event segments may be segmented from the original content as the event segments are identified at operation 304. However, in some embodiments, the event segments may be segmented from the original content after all event segments in the original content have been identified. The event segments may then be stored as individual files in segment database 230.

In some embodiments, segment database may further store segmentation information corresponding to associated content. This may include other audio from the original sporting event. As such, audio segment 334-A may also include audio from associated content. Audio from associated content may be synched to the original content based on actual time, clock time, or run time. Other associated content that correspond to the event segments may be segmented at operation 310. In certain embodiments, statistical play data may also be marked and associated with corresponding event segments 330. In some embodiments, statistical play data may include timestamps for each recorded statistic. The timestamp for a statistic may then be synched to the original content based on actual time, clock time in the original sporting event, or a particular run time position of the original content data file. As such, the particular statistical play data may be associated with a particular event segment in the segment database at operation 308, such as statistical play data 336-A of event segment 330-A.

In some embodiments, social media data may also be marked and associated with corresponding event segments 330. In some embodiments, social media data may be received from various sources, servers, or databases. In some embodiments social media data may be stored as associated content in associated content database 212. For example, viewers watching the original sporting event remotely may post information to social media data exchange servers, such as TWITTER or FACEBOOK, during the original sporting event. This social media data may be received by the segmentation module and correlated with the timing of the broadcast of the original sporting event of the original content. For example, the clock time of the social media posts may synched with the clock time associated with the broadcast of the original content. As such the particular social media data may be associated with a particular event segment in the segment database at operation 308, such as social media data 338-A of event segment 330-A.

The time frame for determining social media posts relevant to a play may be offset from the actual broadcast time of the play and set to begin after the play begins and end after the play ends. For example, an event segment corresponding to a play in a football game may start from the setup at the line of scrimmage by both teams and end with the whistle from an official on the field. In this example, the time frame for relevant social media posts may begin sometime some time before the whistle is blown since much of the exciting action may occur toward the end of the play. The time frame for relevant social media posts may then end during the subsequent event segment to account for viewers posting during the subsequent event segment. The beginning and end of the relevant time frame for social media posts may also vary based on the type of play, for example whether a play is a pass play or a run play, to account for different timing of the most eventful action during the different types of plays.

OCR techniques and word recognition may be implemented to determine the relevance of an association of a social media post to a particular event segment. For example, if a particular event segment is associated with a scoring play based on statistical play data, social media posts corresponding to the particular event segment and following event segments may be processed to determine the presence of keywords associated with the scoring play. Thus, a social media post that was originally associated with a subsequent event segment may be reassigned to the particular event segment with the scoring play. In some embodiments, irrelevant social media posts associated with the particular event segment may be filtered out or unassociated from the particular event segment. Artificial neural networks and other machine learning methods may be implemented for such natural language text reasoning.

Classifying Event Segments

At operation 312, various characteristics of each event segment are identified and associated with the event segment. In various embodiments, the characteristics of an event segment, such as event segment 330-A, are identified based on the audio data, video data, and/or associated content associated with the event segment. The identified characteristics may be stored as segmentation information in the segment database at operation 308.

The various characteristics may be based on statistics extrapolated from statistical play data corresponding to the event segment. Statistical play data may indicate various statistical play characteristics including play type, yardage gained or lost, resulting penalties, position of players, etc. For example, play types of a football game may include pass play, run play, punt, field goal, kick-off, etc. Thus, an event segment from a football game may be identified as a pass play to a tight end that gained five yards with a pass interference penalty. As another example, an event segment from a baseball game may be identified as a ground hit single to third base with a runner on first with two outs. As another example, the statistical play characteristics may indicate which team is the home team or away team, as well as whether the home team or away team is on offense or defense. Statistical play characteristics may be stored in metadata associated with the event segment in segment database 230.

The various characteristics may also include audio characteristics and video characteristics. Audio characteristics determined from audio data in the audio segment may include sounds related to players, officials, the crowd or spectators, or other sounds from the game, as well as the volume of the sounds. For example, audio characteristics of player sounds may include whether the audio pertains to dialogue, audibles, as well as to grunts, yells, or arguments. Audio characteristics related to game officials may include whether the audio pertains to referee or umpire statements, whistles, and other calls. Audio characteristics of crowd sounds may indicate crowd sentiment. Such crowd sound characteristics may include the nature of crowd sounds, such as cheering, booing, gasps, songs, as well as the volume of the crowd sounds. The characteristics of crowd sounds may be determined using various audio recognition techniques. Audio characteristics may also indicate whether the crowd sounds favor the home team or away team, or whether the crowd sounds favor the offense or defense.

As described, characteristics determined from the audio segment may include the volume level of the audio segment. In some embodiments, the volume of an event segment is determined based on the loudness or decibel (dB) level measured or indicated by the audio data of the audio segment. In some embodiments, the volume level of different audio components may be separately measured and recorded. For example, the volume of field sounds, player sounds, crowd sounds, and announcer sounds may each be separately determined. In some embodiments, the volume of event segments may be characterized by decibel ranges. For example, high volume event segments may include an average volume above 100 dB, medium volume event segments may include an average volume between 70 and 99 dB, and low volume event segments may include an average volume below 69 dB.

The various video characteristics may be determined based on video and image data from the video segment. Video characteristics may include camera speed, player movement speed, play type, etc. For example, analysis of video data, with object recognition or motion analysis, may determine whether the ball was passed in a football game to determine whether the play was a pass play or a run play. Motion of objects or pixels in the event segment may also be tracked and analyzed to determine the speed of the camera movement or the average speed of the players or how many players were involved in a play. The video characteristics for each event segment may be assigned a predetermined value.

In various embodiments, the audio and video processing techniques previously described may also be implemented to identify the characteristics of the event segments. OCR techniques may be used to analyze closed captioning text or other onscreen text to determine whether the event segment involves a penalty, score, or turnover. For example, in a football game, OCR techniques may also be implemented to recognize the current yard location, the number of the down and the required yardage. As another example, OCR techniques may be implemented to detect a change in the score displayed in a graphical display in the video to determine whether a play in an event segment resulted in a score, as well as the amount of the score.

Neural networks and machine learning techniques may also be implemented to recognize play types, such as passes or runs in a football game. Segmentation module 220 may also include a neural network or machine learning techniques trained to recognize types of crowd sounds, such as cheering or booing.

Other characteristics may include viewer characteristics based on the social media data that has been associated with a particular event segment. Viewer characteristics may include types of feedback from viewers of the original sporting event other than the crowd or spectators present at the original sporting event. As used herein, people present at the original sporting event may be referred to as "spectators" or "crowd", while the term "viewer" refers to a person watching or listening to the original sporting event that are not spectators or crowd members, such as over television or internet broadcast for example. As used herein, the term "audience" refers to a people viewing or listening to a virtual sporting event generated by the described systems and methods.

Viewer characteristics may be determined based on the social media data associated with the event segment. As previously described, the social media data may comprise any number of social media posts that have been associated with the event segment based on time synching and other processing techniques. As such, the quantity of viewer feedback garnered by particular plays or events in an event segment may be determined. For example, based on the time frame a particular play was televised and the actual time that various social media posts were posted online, the system may determine that the particular play corresponds to a particular number of social media posts. OCR techniques and word recognition may also be implemented to determine and characterize whether the social media posts were positive or negative toward the corresponding play or event. Artificial neural networks and other machine learning methods may be implemented for such natural language text reasoning.

Once characteristics are identified, the event segments may be classified based on the identified characteristics at operation 314. Various categories may be used to classify the event segments, and event segments may be classified into multiple categories. In some embodiments, an event segment may be classified by associating one or more tags with the event segment, where each tag corresponds to a category, such as tags 350-A of exemplary event segment 330-A. Such classifications may then be stored in the segment database at operation 308. In some embodiments, the classifications are stored in metadata of the original content data or associated content data.

In various embodiments, categories may include statistical play categories based on statistical play characteristics, such as players involved, length of the play, timing of the play in the game (time position), type of play, result of the play, position on the field, etc. For example, statistical play categories for event segments of a football game may include run plays, pass plays, special plays, punts, etc. Event segments categorized as pass plays may further be classified based on position of players involved or result, such as plays involving the running back, the tight end, turnover passes, etc. Event segments categorized as pass plays may further be classified into categories of incomplete passes and complete passes. The event segments classified as complete passes may further be classified by yardage gained or lost. The yardage gained or lost categories may be divided into a range of one or more yards gained or lost.

In some embodiments, the range of yardage may vary based on frequency of such events. For example, plays gaining between 0-15 yards may be divided into separate categories corresponding to each number of yards gained because they occur more often. Plays gaining between 15-19 yards may be grouped into one single category, and plays gaining more yardage may be grouped into a category with a larger range, such as 20-29 yards gained, 30-49 yards gained, and 50+ yards gained, as plays resulting in such yardage occur with less frequency.

In general, categories based on statistical characteristics may correspond to objective qualities of an event segment. However, statistical characteristics may also be used to determine subjective qualities, such as play difficulty. Other categories based on identified audio and video characteristics may correspond to subjective qualities, but may be classified using objective measures, as described above. The other categories may include play intensity, play difficulty, or play speed. For example, event segments may be categorized by high, medium, and low play intensity; high, medium, and low play difficulty; and fast and slow play speed. Event segments may be placed into such categories based on audio or video characteristics as described above.

The play intensity, play difficulty, and play speed of an event segment may be classified based on video data from the corresponding video segment and/or audio data from the corresponding audio segment. For example, the level of play intensity may be determined by the volume characteristics of sounds from the field or players. The level of play intensity may be determined by detected motion and speed characteristics in the event segment which may indicate how much movement occurs during the play, the speed of player movement, or the number of players involved in the play.

The level of play difficulty may also be determined by the types of sounds and volume of sounds from the field or players. For example, event segments with louder audio may be classified with a higher level of play difficulty. The play difficulty of an event segment may also be determined by statistical data. For example, if the particular team had a low percentage of third down conversions in a particular football game, then an event segment corresponding to a third down play may be classified as a high difficulty play.

The play speed may be determined based on the length of the event segment. For example, shorter event segments may be classified with a faster play speed. In some embodiments, the play speed may also be determined by detected motion in the play which may indicate the speed of player movement.

Other categories may include crowd sentiment of spectators. For example, event segments may be categorized by positive, negative, or neutral crowd sentiment. Each crowd sentiment category may further be categorized as high, medium, or low sentiment. The crowd sentiment of an event segment may be classified based on the associated audio data, such as audio characteristics of crowd sounds, including types of crowd sounds and volume of the crowd sounds. Event segments may also be categorized by crowd sentiment based on the characteristics of corresponding social media data.

As shown in method 300, event segments are classified after characteristics are identified at operation 314. However, it should be recognized that event segments may be classified based on the characteristics as each characteristic is identified.

Virtual Event Creation

Figure 4A:
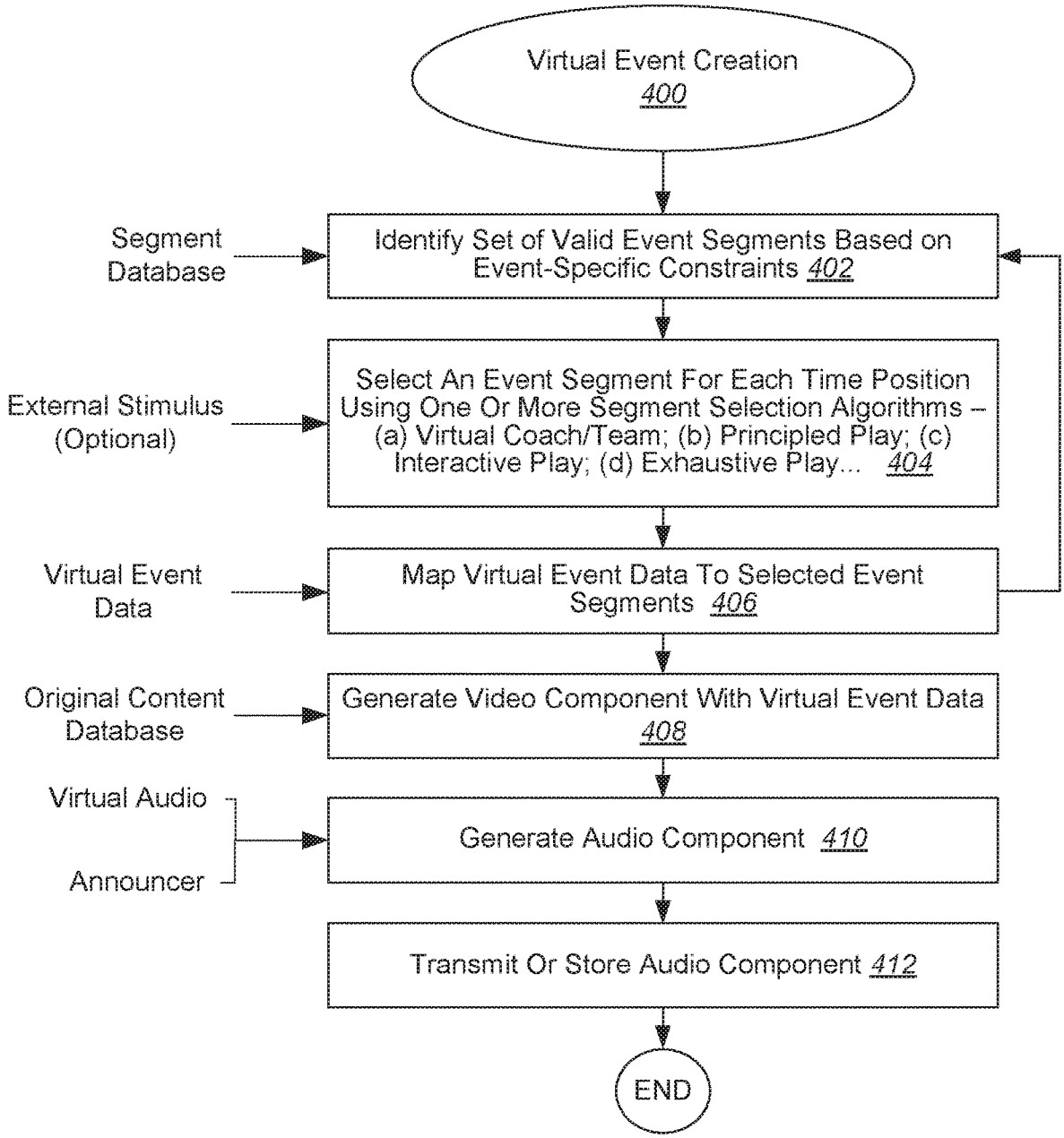
FIG. 4A is an example method for virtual event creation, in accordance with one or more embodiments.

The stored and classified event segments may then be concatenated together in various orders to form an entire virtual sporting event, as will be further described. Segment selection module 240 may be configured to select one or more event segments for each time segment of the virtual sporting event. In some embodiments, the virtual sporting event is comprised of one or more consecutive time segments. Each time segment may vary in length of time, and may comprise one or more event segments. In some embodiments, the length of each time segment may be equal to the length of the one or more event segments selected for such time segment. With reference to FIG. 4A, shown is an example method 400 for virtual event creation, in accordance with one or more embodiments. Method 400 may be implemented by a server of virtual event system, such as segment selection module 240 and/or audio creation module 260.

At operation 402, a set of valid event segments for a particular time segment of the virtual event is identified based on event-specific constraints. In some embodiments, an event segment may be selected for a particular time segment subject to certain constraints based on the event segment selected for the previous time segment. Such constraints may correspond to the progression of the game, such as field position of the ball in a football game or the number of outs in an inning in a baseball game. For example, in a virtual football game, if the event segment for a time segment indicates that the ball is at the forty-five yard line, then the event segment selected for the subsequent time segment may be required to start with the ball at the forty-five yard line. However, selection of event segments for other types of sporting events may not be subject to such constraints.

Another constraint may be based on remaining clock time in the virtual sporting event. For example, if the virtual event is nearing a designated stopping point, such as the half time of a basketball game, the valid event segments may include event segments with a length of time under a predetermined value. Other constraints may require the event segment to include a particular amount of spectator sentiment or excitement so that there is minimized change in spectator sentiment levels between event segments of adjacent time positions. In some embodiments, the constraints may be determined by various segment selection algorithms further described herein.

Multiple valid event segments may be identified that meet the constraints for the particular time position of the virtual event. One or more valid event segments may then be selected for the time segment based on a combination of one or more different segment selection algorithms at operation 404. For example, a valid event segment may be randomly selected for the time position. However, other segment selection algorithms may be implemented. Described herein with reference to FIGS. 6A-6D are various segment selection algorithms and methods including a Virtual Coach algorithm, a Virtual Team algorithm, a Principled Play algorithm, an Interactive Play algorithm, and an Exhaustive Play algorithm. One or more of the segment selection algorithms may utilize machine learning techniques or neural networks to determine probabilities of occurrence for various types of plays at various field positions and other progress points of a sporting event.

Once event segments have been selected for each time segment of the virtual sporting event, virtual event data is mapped to the selected event segments at operation 406. Such selected event segments may be transmitted to event data module 250. In some embodiments, information corresponding to the selected event segments is transmitted to event data module 250. Such information may include identification of the selected event segments and information about the identified characteristics and classified categories for the selected event segments. In various embodiments, identification of the selected event segments are transmitted to event data module 250, which may be configured to access information corresponding to the selected event segments stored in segment database 230. In various embodiments, event data module 250 is configured to map virtual event data to the selected event segments. Virtual event data may be retrieved from event database 252, and may include virtual audio and fictional character information.

Event database 252 may store various virtual audio corresponding to various types of sporting events. Such virtual audio may be artificially created or recorded from other original sporting events. However, in some embodiments, the virtual audio is unrelated to the plays or events included in the event segments to which they are mapped. Virtual audio may include the similar types of sounds as in the original or associated content, including sounds from the field, the players, the crowd or spectators, or officials such as referees or umpires. For example, virtual audio for a football game may include an audible or dialogue between players, contact or hitting sounds, whistles, etc. Event data module 250 may select virtual audio for a particular event segment based on the characteristics determined from the original audio in the original content or associated content. For example, if the associated content corresponding to a particular event segment included loud contact or hitting sounds between players, similar virtual audio may be retrieved from the event database and mapped to the event segment.

Event database 252 may also store fictional character information including information about fictional players, coaches, teams, officials. For example, fictional character information may include biographies and historical statistics. In some embodiments, fictional character information may be based in whole, or in part, on existing or actual historical individuals, such as players, coaches, and teams of that sport. For example, two fictional teams may be selected for a virtual football game. The players on the fictional teams may then be mapped to the players included in the event segments selected for the virtual football game based on the respective positions. For example, the fictional quarterback from a selected fictional team may be mapped to the quarterback in a selected event segment, including the fictional quarterback's name, number, and biographical history.

In some embodiment event data module 250 may further aggregate the virtual event data to derive virtual game statistics or virtual statistical play data. For example, the cumulative clock time of the virtual sporting event may be calculated. In some embodiments, the event data module 250 may take into account various situations in a sporting event such as timeouts, pauses, or breaks. As another example, scoring plays may be tallied at each time segment to determine the score at any given time position of the virtual sporting event. As another example, penalties may be determined and tracked such that penalty consequences for penalty violations for particular sports may be implemented in the virtual sporting event. For example, if a particular fictional player is ejected based on a penalty violation, that fictional player will be replaced by another fictional player from fictional character information. In some embodiments, such virtual game statistics may be transmitted to segment selection module 240 to affect the selection of event segments at operation 402 or operation 404. For example, if a player in a hockey match is placed in a penalty box, the segment selection module may only select event segments where a particular team plays shorthanded.

In some embodiments, the virtual event data is mapped to corresponding selected event segments at event data module 250, and then transmitted to audio creation module 260 to be displayed with the appropriate selected event segments. In some embodiments, virtual event data, such as fictional character information and fictional game statistics are generated and compiled at event data module 250 and transmitted to audio creation module 260. In some embodiments, information identifying particular mapped virtual event data, such as virtual sounds, is transmitted to audio creation module 260, which retrieves the virtual event information from event database 252. However, in other embodiments, the selected event segments are transmitted to event data module 250 where they are combined with the selected virtual event data before being transmitted to audio creation module 260.

At operation 408, a video component of the virtual event is generated from the selected event segments at audio creation module 260. Audio creation module 260 may be configured to integrate the selected event segments and mapped virtual event data into a video component of the virtual sporting event. In various embodiments, the segment selection information may be transmitted to audio creation module 260 which may retrieve the selected segments from the original content stored in original content database 210. As such, the video segments of the identified segment may be transmitted to the audio creation module. Audio creation module 260 may be configured to extract only the identified video segments corresponding to the selected event segments. However, in some embodiments, the audio segments of the identified event segments may also be received at audio creation module 260, such as in file formats where audio and video data are combined.

Figure 4B:
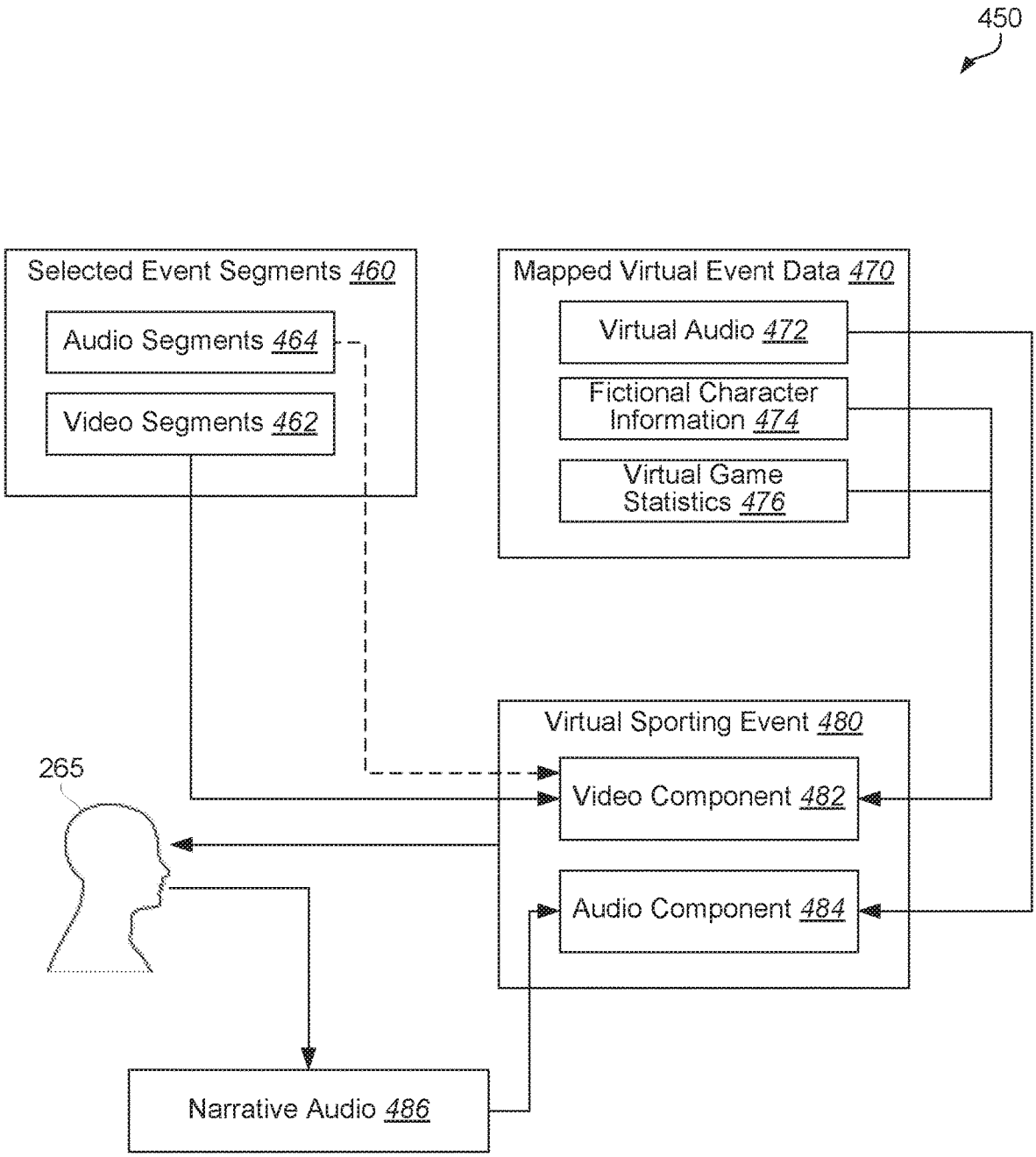
FIG. 4B illustrates an example flow process for generation of audio and video components of a virtual sporting event, in accordance with one or more embodiments.

FIG. 4B illustrates an example flow process 450 for generation of audio and video components of a virtual sporting event, in accordance with one or more embodiments. One or more operations of method 400 may be described herein with reference to flow process 450. FIG. 4B shows selected event segments 460 selected at operation 404 by one or more various segment selection algorithms. As previously described, each of the selected event segments 460 may comprise video segments 462 and audio segments 464. FIG. 4B also shows mapped virtual event data 470 from operation 406. As previously described, mapped virtual event data 470 may include virtual audio 472, fictional character information 474, and virtual game statistics 476. Selected event segments 460 and mapped virtual event data 470 may be used by audio creation module 260 to generate virtual sporting event 480.

Various video processing techniques may be implemented to extract the data corresponding to the selected event segments from the original content data and combine the data into the video component 482 of the virtual sporting event 480. The video data of the selected event segments may be positioned chronologically according to the time sequence of their respective time segments.

In some embodiments, the video component 482 of the virtual sporting event may be desensitized by removing color, sound, and other attributes from the original content data. In various embodiments, the color may be stripped from the video via signal processing techniques. In various embodiments, the audio data may be isolated and removed from the event segment data. Other attributes of the video which may be removed include game information, such as scores, clock times, and other information displayed on graphical information panels in the original content.

In some embodiments, the mapped virtual event data 470 may then be incorporated with the desensitized video component of the virtual sporting event. In some embodiments, the virtual event data may be displayed within or overlaid on the video of the time segments. In some embodiments the virtual event data may be displayed on a separate screen, window, or panel as the corresponding event segments are displayed.

At operation 410, the audio component 484 of the virtual sporting event 480 may then be generated at audio creation module 260 based on the video component 482 generated at operation 408. In some embodiments, the audio component includes the virtual audio mapped to the selected event segments. The virtual audio may be combined as a separate data file, or stored within the same data file as the corresponding desensitized video component. As such, the mapped virtual sounds may be played as the corresponding desensitized video component is displayed to a user.

Figure 5:
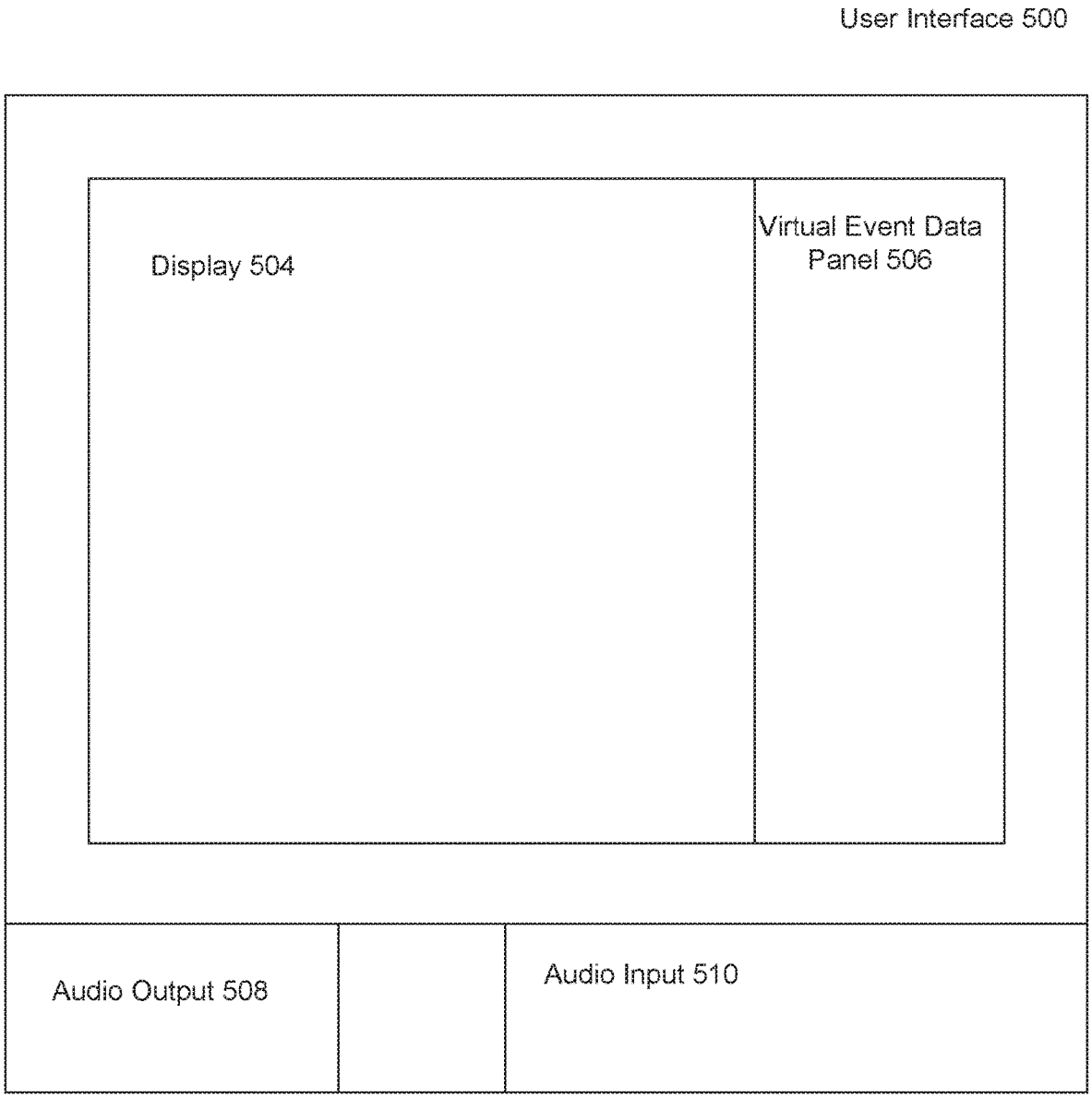
FIG. 5 is an example user interface for displaying a video component of a virtual sporting event, in accordance with one or more embodiments.

In some embodiments, the audio component also includes narrative audio 486, which may be created by one or more human commentators, such as announcer 265, viewing the video component. In certain embodiments, the video component of the virtual sporting event may be displayed at a user interface for viewing by announcer 265 or other user. With reference to FIG. 5, shown is an example user interface 500 for displaying a virtual sporting event, in accordance with one or more embodiments. In various embodiments, user interface 500 is communicatively coupled to audio creation module 260. In some embodiments, user interface 500 may be an integrated component of audio creation module 260.

Video component 482 may be displayed at display 504 including the virtual event data 470 including the virtual sounds, fictional character information, and accumulated scoring and other virtual game statistics. The fictional character information and virtual game statistics may be displayed on the user interface at panel 506. In various embodiments, panel 506 may be a graphical information panel or overlay on the video component, for example. However, in some embodiments, panel 506 may be a separate window on display 504. In yet other embodiments, panel 506 may be another display separate from display 504. Virtual audio 472 may be presented via audio output device 508. In some embodiments, the video component is displayed without desensitization, along with corresponding original audio segments 464 from the corresponding selected event segments.

Announcer 265 may then record narrative audio 486 into an audio input device 510 based on the video component and virtual event data. Narrative audio 486 may comprise commentary, analysis, or other dialogue pertaining to the virtual sporting event and associated virtual event data. The recorded narrative audio 486 may then be combined with the virtual sounds to generate audio component 484 of the virtual sporting event. As used herein, audio component 484 generated at audio creation module 260 may be referred to as "non-interactive audio." Non-interactive audio may refer to audio component comprising audio selected and created entirely by virtual event system 200 and excluding audio from external sources, such as client devices.

In optional embodiments, audio from external sources, such as client devices corresponding to one or more audience members of the virtual sporting event, may be received by system 200. Such audio may be referred to herein as "interactive audio" which comprises sound data generated by audience members. Interactive audio module 280 may be configured to receive and process the interactive audio and combine the interactive audio with the non-interactive audio for transmission to at least a portion of the audience members.

In some embodiments narrative audio 486 may also comprise advertisements or other information from sponsors. In some embodiments, advertisements and information from sponsors may be separate audio data that is incorporated into audio component 484 prior to or during transmission of the audio component to client devices corresponding to the audience members. In some embodiments, the commentary may also be automatically generated by a computer system which provides speech and dialogue based on the virtual event data. For example, a computing system may generate a script based on the mapped virtual event data and implement text-to-speech programs to read the script.

At operation 412, the audio component is transmitted or stored. In some embodiments, the non-interactive audio may be transmitted via delivery module 270. In some embodiments, delivery module 270 may include a database for storing audio components for one or more virtual sporting events. Delivery module 270 may be configured to transmit the audio component as an audio file to a network, such as network 110. In various embodiments, network 110 may be a global network such as the internet In some embodiments, the audio component is transmitted to client device 278 over Wi-Fi or mobile data. In some embodiments, the audio component is transmitted via radio station server 272 for broadcast via radio transmitter 274. The radio broadcast may then be received by radio receiver 276 and output to user 279. In some embodiments radio receiver 276 may be a component of user device 278.

Methods of Segment Selection

Virtual Coach/Team Selection

As previously described, event segments may be selected by one or more methods, such as at operation 404. Such methods may comprise various segment selection algorithms. With reference to FIGS. 6A-6D, shown are methods for selecting event segments for various time segments of a virtual sporting event, in accordance with one or more embodiments.

Figure 6A:
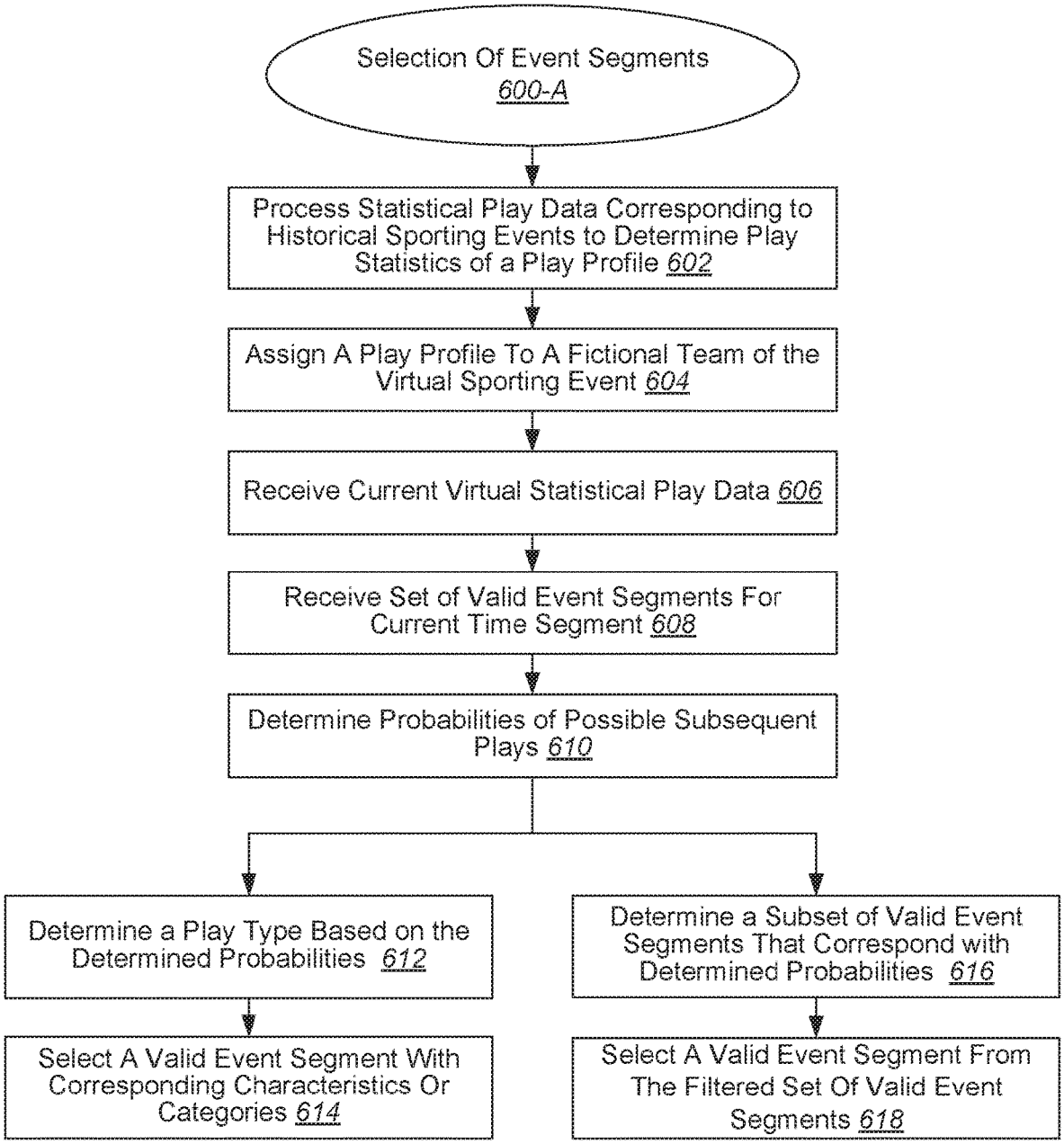
FIG. 6A illustrates an example method for selecting event segments using a Virtual Coach or Virtual Team method, in accordance with one or more embodiments.

A Virtual Coach or Virtual Team method may be implemented to select event segments that include plays with characteristics or classifications based on the predicted decisions of existing teams or coaches and managers of existing teams. With reference to FIG. 6A, shown is an example method 600-A for selecting event segments using a Virtual Coach or Virtual Team method, in accordance with one or more embodiments.

At step 602, statistical play data corresponding to historical sporting events is processed. In some embodiments, the statistical play data may be related to, derived from, or comprised of the statistical play data in the associated content. In some embodiments, statistical play data may be received from third-party vendors. The steps of method 600-A will be described mainly with reference to American football. However, it should be recognized that various other methods of organizing statistical play data may be implemented for different sporting events. In some embodiments, processing the statistical play data may comprise assigning tags to the statistical play data to associate particular data with a grouping. In some embodiments, processing the statistical play data may comprise creating groupings and counting the number of plays that fall within each grouping.

During the processing, the information in the statistical play data may be used to determine decision-making probabilities for each profile. In some embodiments, the statistical play data may be organized by particular play profiles corresponding to particular teams or coaches. For example, statistical play data relating to a team, such as the Oakland Raiders, may be grouped or otherwise associated with an Oakland Raiders play profile. As another example, statistical play data relating to play decisions made by a coach, such as Pete Carroll, may be associated with a Pete Carroll play profile. In some embodiments, the statistical play data may be also be grouped by particular years or seasons. For example, the statistical play data for the Oakland Raiders may be grouped by seasons from 2010 to 2018.

In some embodiments, the plays for each down and yardage requirement at various field positions may be determined and counted. The statistical play data may be further organized by downs, yardage requirements, and field positions. In some embodiments, all first down plays, second down plays, third down plays, and fourth down plays may be determined and grouped based on yardage requirements. For example, all second down plays with 10 yards to the first-down line (2nd and 10) may be grouped. The system may similarly group all 2nd and 9 plays, 2nd and 8 plays, 2nd and 7 plays, and so on. In some embodiments, the plays may be grouped by ranges of yardage requirements. For example, second down plays with 0-2 yards to go may be grouped, second down plays with 2 or more to 6 yards to go may be grouped, second down plays with 6 or more to 10 yards may be grouped, and second down plays with 10 or more yards to go may be grouped. The ranges of yard requirements may be determined based on a number of different features or characteristics. For example, ranges of yard requirements may be grouped such that each grouping includes a number of plays that is above a predetermined threshold amount. As another example, the ranges of yard requirements may be grouped such that each grouping includes approximately the same sample size of plays.

The statistical play data may be further organized by ranges of field positions. The ranges of field position may vary in size and may vary between different profiles. For example, the relevant yard ranges for the Oakland Raiders profile may be the 0 to 20 yard line up-field, the 20 to 50 yard line up-field, the 50 to 30 yard line down-field, the 30 to 10 yard line down-field, and the 10 yard line to the goal line down-field. The statistical play data may be organized into additional groups or fewer groups than those described. Additional groups may include ranges of in-game clock time and weather conditions.

Play statistics for each play profile may then be determined based on the groupings. The proportion of various play types within each grouping may be determined. For example, the percentage of occurrence of each play type that occurs at various down and yardage requirements at various field positions may be determined. For example, the Oakland Raiders profile may indicate that on when the team is within the down-field 20 yard line to 10 yard line on third down with 6 or more to 10 yards to go, the team passes the ball 90% of the time, runs the ball 9% of the time and attempt a field goal 1% of the time.

At step 604, a play profile is assigned to at least one team of the virtual sporting event. For example, the Oakland Raiders play profile may be assigned to one of the teams of the virtual sporting event. Thus, when the assigned team is on offense, method 600-A will be used to select event segments for the assigned team. In some embodiments, both teams in the virtual sporting event may be assigned a play profile. In some embodiments, more than one play profile may be assigned to a particular team. If more than one play profile is assigned to a particular team, the play statistics for groupings in both profiles may be combined. As such, it is possible to create a game between two existing teams based on the statistically likely decisions that would be made by such teams in a desired year or season.

At step 606, the current virtual statistical play data is received. As previously described, the event data module may aggregate the virtual event data in selected event segments to derive the current virtual statistical play data, such as at operation 406. The current virtual statistical play data may indicate that the assigned team is on offense. If the assigned team is currently on offense, then a set of valid event segments for the current time segment is received at step 608. The set of valid event segments may be identified at operation 402 as previously described.

At step 610, the probabilities of possible subsequent plays are determined based on the play statistics of the assigned play profile. In various embodiments, the segment selection module may reference the statistical play data processed at step 602 to determine the probabilities of possible subsequent plays based on the current virtual statistical play data. For example, if the current virtual statistical play data indicates that the ball is at the 12 yard line during a third down, then the segment selection module references the percentages of each play type in the assigned profile in that situation (down, yard requirement, and field position). In the present example, the assigned Oakland Raiders profile would indicate a 90% chance for selecting a pass play, a 9% chance of selecting a run play, and a 1% chance of selecting a field goal attempt.

Method 600-A may then proceed to step 612 to determine a play type based on the probabilities determined at step 610. In the present example, the segment selection module may determine a play type from a pass play, run play, or a field goal attempt. The likelihood that each type of play will be determined may be based on the determined probabilities. Thus, there would be a 90% chance of selecting a pass play, a 9% chance of selecting a run play, and a 1% chance of selecting a field goal attempt.

At step 614, method 600-A selects a valid event segment that includes identified characteristics or classified categories that correspond to the determined play type. In some embodiments, an event segment corresponding to such play type is randomly selected from the set of valid event segments. In some embodiments, a subset of valid event segments that correspond to the determined play type may be determined and a single event segment is selected from the subset based on additional factors or by other segment selection methods.

Alternatively, method 600-A may then proceed to step 616 to determine a subset of valid event segments that correspond with the play types determined at step 610. The play types represented in the subset of valid event segments may be in proportion to the probabilities determined at step 610. The segment selection module may filter the set of valid event segments by identifying a filtered subset of valid event segments that include plays in proportion with the determined probabilities. In some embodiments, the segment selection module may identify a predetermined number of event segments. The predetermined number may be a maximum number. For example, the segment selection module may identify 100 event segments to select for a particular time segment. The 100 identified event segments will include a proportional amount of event segments corresponding to the probabilities of play types determined at step 610. Thus, in the present example, 90 out of the 100 identified event segments will correspond to pass plays, 9 out of 100 identified event segments will correspond to run plays, and 1 out of 100 identified event segments will correspond to field goal attempts.

In various embodiments, the filtered subset of event segments may be identified randomly. For example, the 90 event segments corresponding to pass plays may be randomly identified from the segment database. A valid event segment is then selected from the filtered set of event segments at step 616. For example, the valid event segment may be randomly selected from the filtered subset of valid event segments. In some embodiments, the selection may be further narrowed by other factors such as success rate of the play indicated by the event segment, or by another segment selection method.

In some embodiments, a Virtual Coach or Virtual Team algorithm may implement a neural network trained on data compiled for an existing coach or team to select event segments based on decisions corresponding to a combination of one or more teams or coaches. For example, training input may include values corresponding to various characteristics at a particular play in a historical sporting event, such as the clock time, the current score, the position on the field, and the down and yardage requirements. The training input may be input as a feature vector along with a known training output value corresponding to the type of play, such as a pass, run, etc. Based on the training data, the neural network may update weighted coefficients for each characteristic used in the training data. Once fully trained, the probabilities of various types of plays may be determined based on the weighted coefficients and characteristics indicated by the current statistical play data of the virtual sporting event.

Principled Play Selection

Figure 6B:
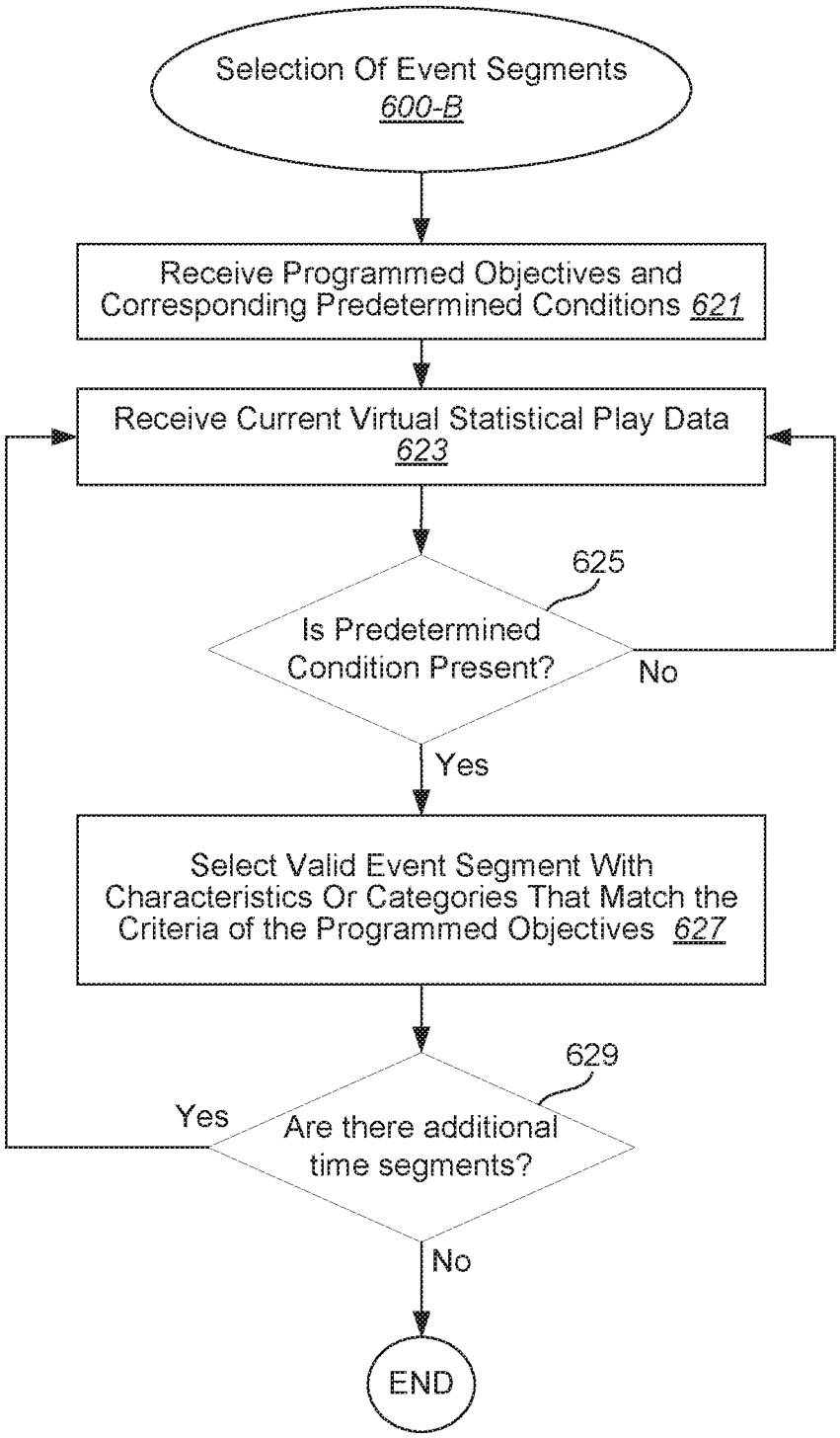
FIG. 6B illustrates an example Principled Play method for selection of event segments, in accordance with one or more embodiments.

A Principled Play method may be implemented to select event segments based on a combination of one or more specific programmed objectives. With reference to FIG. 6B, shown is an example Principled Play method 600-B for selection of event segments, in accordance with one or more embodiments. In some embodiments, the Principled Play algorithm selects event segments based on the classifications or characteristics of the event segments that support the programmed objectives.

At step 621, one or more programmed objectives are received, which may include corresponding predetermined conditions. For example, such programmed objectives may include selecting plays that generate the most yardage gained. The programmed objectives may include selecting plays with the most crowd excitement based on audio characteristics of crowd sound or social media posts. The programmed objectives may include selecting plays that result in the highest scores. The programmed objectives may include selecting plays under a certain length of time.

The predetermined conditions associated with the programmed objectives may identify qualifying events for the programmed objectives. For example, the programmed objectives may be desired to occur at particular downs in a virtual football game, such as to select plays that generate the most excitement during third down plays. As another examples, programmed objectives may be desired to occur with a particular amount of in-game clock time remaining, such as to select plays under a certain length of time when there are two minutes or less remaining in the clock time.

For example, the programmed objective may be to select event segments with third-down plays that generate the most yardage. The algorithm may then identify a group of all valid event segments corresponding to third-down plays that resulted in a gain of twenty or more yards.

At step 623, current virtual statistical play data is received. As previously described, the event data module may aggregate the virtual event data in selected event segments to derive the current virtual statistical play data, such as at operation 406. It is then determined whether a predetermined condition is present at 625. If the predetermined condition is not present, method 600-B may return to step 623 to continue receiving virtual statistical play data as event segments are selected via other segment selection methods. If the predetermined condition is present, method 600-B proceeds to step 627 to select a valid event segment that includes characteristics or categories that match the criteria of the programmed objectives. In some embodiments, there may be no predetermined conditions and the programmed objectives may apply to all time segments. As such, in some embodiments, step 625 may be an optional step.

At step 627, a valid event segment with characteristics or categories that match the criteria of the one or more programmed objectives is selected. The characteristics or categories of each valid event segment may be identified and classified, respectively, during the segmentation process of method 300. In some embodiments, an event segment with matching criteria may be randomly selected from the set of valid event segments. In some embodiments, additional programmed objectives may be applied. The identified group of all valid event segments may be narrowed down by programmed objectives until a single event segment can be identified. In some embodiments, the Principled Play algorithm implements a predetermined hierarchy of programmed objectives. In some embodiments, an event segment may also be selected from the set of valid event segments based on implementation of other segment selection method described herein.

It is then determined whether there are additional time segments at 629. If there are additional time segments requiring event segments to be selected, then method 600-B may return to step 623 to receive additional virtual statistical play data for subsequent time segments. If all event segments have been selected for all time segments, then method 600-B ends.

Interactive Play Selection

Figure 6C:
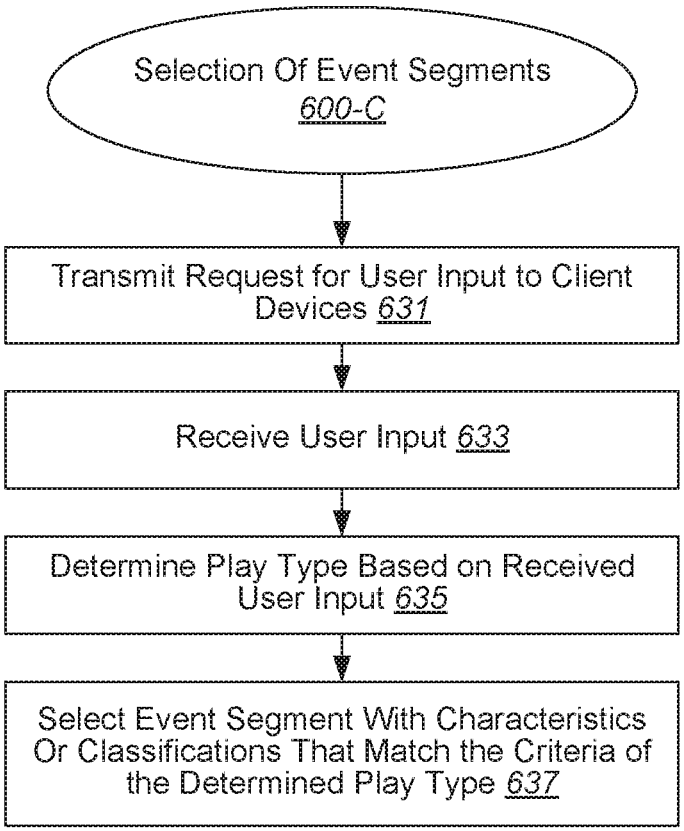
FIG. 6C illustrates an example Interactive Play method for selection of event segments, in accordance with one or more embodiments.

An Interactive Play algorithm may select event segments based on external input, such as that received by users listening to the virtual sporting event. For example, users, such as user 279, may use corresponding client devices, such as client device 278, to input vote selections on the type of play to be selected for a subsequent time segment. With reference to FIG. 6C, shown is an example Interactive Play method 600-C for selection of event segments, in accordance with one or more embodiments. Although method 600-C described with reference to desired play types, it should be recognized that method 600-C may be implemented to select event segments correspond to a number of other types of desired characteristics, such as players involved in a play, penalty calls, player substitutions, etc.

At step 631, a request for user input is transmitted to one or more client devices. In some embodiments, client device 278 may be any one of client devices 102-108 described with reference to FIG. 1. The request may comprise audio and/or visual prompts to the user. For example, the request of user input may comprise text which may display at the client devices via an application or web browser to request user input corresponding to a selection for one or more play types or strategies, such as pass plays, run plays, etc. The request for user input may display selection options on the client device. For example, the request may display a selection for a run play and a selection for a pass play. As such, the user input may be an indication of a manual selection. The request may also comprise accompanying audio or video instructions for the user selection. As another example, the request may request audio user input. For example, the request may prompt users to cheer or yell if a pass play is desired, or to boo or jeer if a particular action in the virtual sporting event is desired.

The request may be transmitted only to client devices corresponding to users that meet predetermined criteria. For example, requests may only be transmitted to users who have registered through an application. As another example, advertising data may be used to identify users eligible to receive requests for user input, such as users who have recently purchased fuel at participating gas stations.

At step 633, user input is received at the system. The input may be received at anyone of various components of system 200 via network 110. Such input may be transmitted via the network to segment selection module 240 or other client device interface. In some embodiments, such input may be transmitted via the network to biasing module 290, which will be further described below. Such user input may be a user selection in an application executed on the client device. In some embodiments, input may be audio input received at the client device, such as cheering, or yelling confirmation for a particular play type. The input may also be received as a text message or voice call sent via the client device. The manner of receiving user input may be chosen by user activity while listening to the virtual sporting event. For example, a user may be listening while driving in an automobile. The application may provide an option for receiving audio input, which may require limited physical or visual interaction with the client device. In other embodiments, the application may request confirmation that the user is a passenger or not currently driving before input may be received.

At step 635, the desired play type is determined based on the received user input. Audio input may be processed by voice or speech recognition techniques to determine whether the nature of the user input, such as whether they comprise cheers or jeers. The desired play type may be determined based on various predetermined requirements or thresholds.

In some embodiments, the selection option corresponding to the majority of user input may determine the desired play type. In some embodiments, a desired play type may be determined if user input exceeds a predetermined threshold. For example, if user input is received from more than 50% of client devices executing applications for receiving the virtual sporting event, then the play type corresponding to the user input may be determined to proceed.

An event segment with characteristics or classifications matching the criteria of the determined play type is selected at step 637. For example, the majority of user input may indicate a selection for a team to pass on the next fourth down. As such, the Interactive Play algorithm may identify valid event segments corresponding to pass plays. A pass play event segment may then be selected randomly or based on another segment selection algorithm as described herein.

Exhaustive Play Selection

Figure 6D:
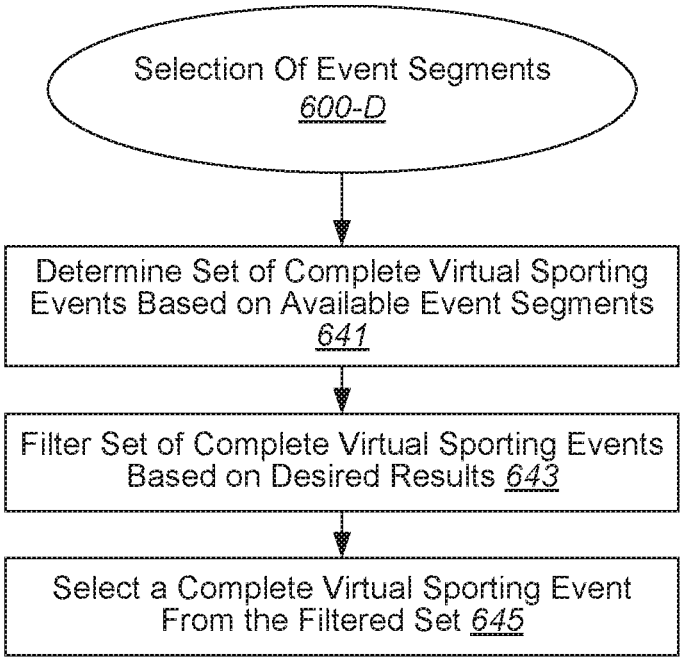
FIG. 6D illustrates an example Exhaustive Play method for selection of event segments, in accordance with one or more embodiments.

An Exhaustive Play algorithm may be implemented to determine an exhaustive set of complete virtual sporting events based on combinations of all possible event segments. With reference to FIG. 6D, shown is an example Exhaustive Play method 600-D for selection of event segments, in accordance with one or more embodiments.

At step 641, a set of one or more complete virtual sporting events is determined based on available event segments. For example, a first event segment corresponding to the first play of a virtual football game may be selected for a first time segment (t). In some embodiments, one of the various segment selection methods described herein may be implemented to select event segments for each time segment of the virtual sporting events in the set. Once an event segment is selected for a time segment (t) by one or more of the segment selection methods, constraints for the subsequent time segment (t+1) may be identified based on the selected event segment for time segment (t), at operation 402. A separate virtual sporting event may be created for each possible event segment that may be selected for a subsequent time segment (t+1). As such, method 400 may repeat operations 402 and 404 for each generated virtual sporting event until event segments have been selected for each time segment of all possible virtual sporting events.

At step 643, the set of complete virtual sporting events is filtered based on desired results. The exhaustive set of complete virtual sporting events may then be evaluated based on a combination of various desired results, such as outcome, excitement level, etc. For example, a complete virtual sporting event may be selected from the exhaustive set based on the result that the outcome of the game is determined by the final play. The set of all possible complete virtual sporting events may be filtered to obtain a subset of complete virtual sporting events with outcomes that are determined by the final play. Then a complete virtual sporting event may be selected from the filtered subset at step 645. A complete virtual sporting event may be selected at step 645 at random or based on other desired results, such as victory by a particular team.

Interactive Audio Generation

Figure 7:
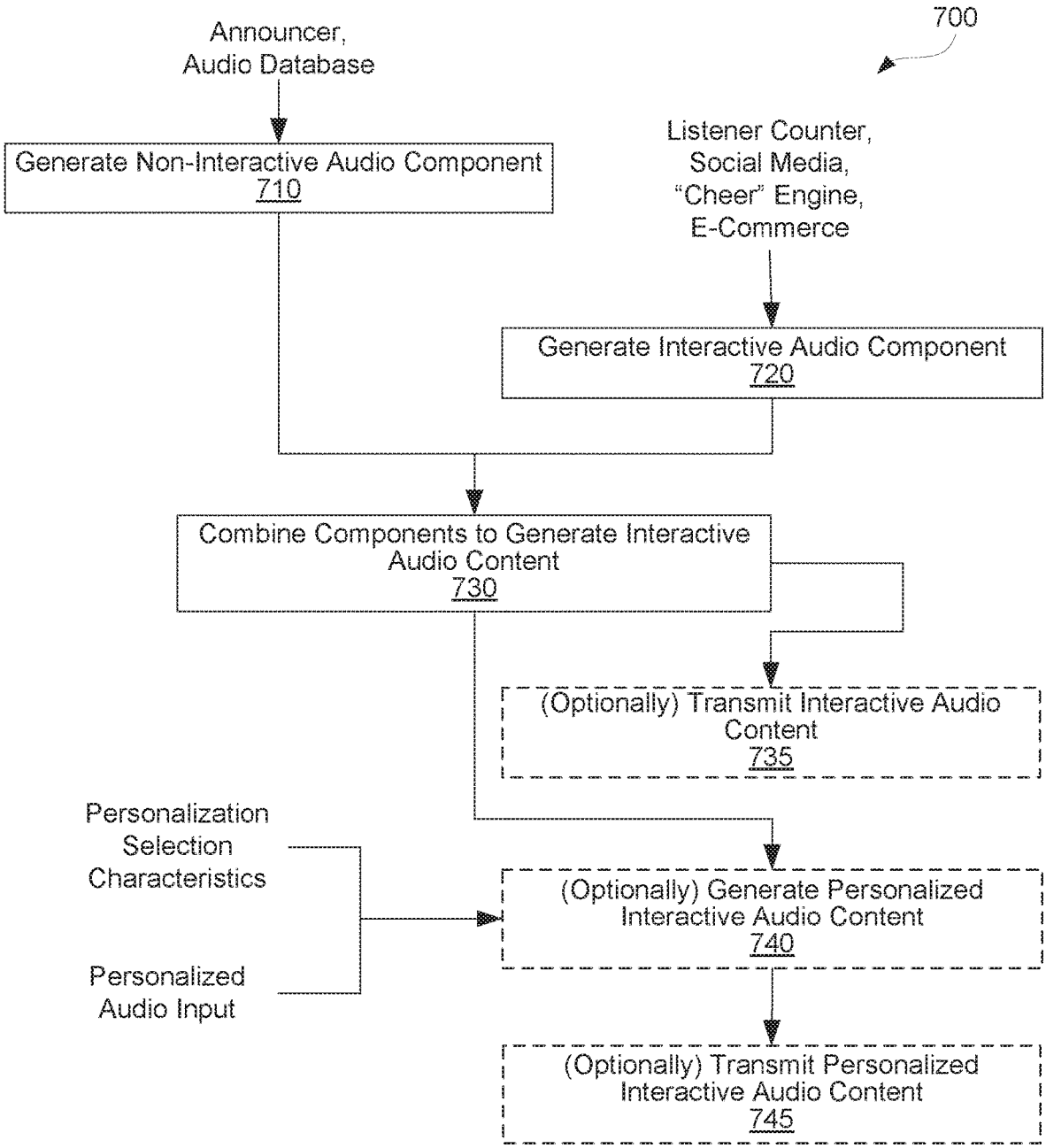
FIG. 7 illustrates an example process for generating interactive audio for a virtual sporting event, in accordance with one or more embodiments.

Various interactive features may be added to non-interactive audio component to enhance the overall audio experience and, more specifically, to create a more realistic representation of a live event. FIG. 7 illustrates an example process 700 for generating interactive audio for a virtual sporting event, in accordance with one or more embodiments. At step 710, a non-interactive audio component is generated, such as described with reference to FIGS. 4A and 4B.

At step 720, an interactive audio component is generated. In some embodiments, users (279) receiving the virtual sporting event audio at user devices (278) may transmit user input to virtual event system 200, including audio input, video input, and various other selections. Such user input may be received at an interactive audio module 280. In some embodiments, the user input may be a user selection in an application at the client device. The user input may alternatively be input at another peripheral device connected to the client device, which may include buttons or a touch-screen.

In some embodiments, audio input from one or more client devices may be received by interactive audio module 280 of virtual event system 200. Such audio input may include various audio data created by listening users, such as user 279, which may include cheering, jeers, comments, clapping, etc. Interactive audio module 280 may be configured to receive and aggregate this audio data from the one or more client devices to create an interactive audio component. At step 730, this interactive audio component may then be combined with the non-interactive audio at audio content integration module 262. This combination of the interactive audio component and the non-interactive audio component may be referred to as hybrid audio.

For example, the number of client devices receiving and playing the audio component may be detected. In some embodiments, an increase in the number of connected client devices may increase the volume and frequency of crowd sounds from the virtual event data added to the audio component. Similarly, sounds (such as cheers, jeers, or yelling) from listeners may be recorded at the client devices and transmitted to interactive audio module 280. In some embodiments, the amount or volume of the audio received from the client devices may affect how frequent or loud the virtual crowd audio in the audio component is. In some embodiments, the actual audio from the audio transmitted by the client devices is included in the audio component such that listening users may hear the actual cheers or comments of another user in real-time or near real-time.

In some embodiments, social media posts may be received as user input and processed to affect the transmitted audio component. For example, the text of a social media post may be recognized and transformed into audio dialogue by various text to speech processing techniques, and be integrated into the transmitted audio component. In some embodiments, social media posts may be converted to a corresponding virtual crowd sound to be incorporated into the transmitted audio component.

In some embodiments, wagers or purchases may be received and tracked to influence the audio. For example, the application may display an advertisement at the client device for a particular product and provide a process for purchase of such product. In-application purchases may be tracked and a larger number of purchases may result in virtual audio supporting a particular team. Similarly, the application may display a process for making donations to particular charities associated with different teams. In-application donations may be tracked and donations to one charity or another may result in virtual audio supporting the associated team.

In various embodiments, hybrid audio may be transmitted over the network by delivery module 270 at step 735. As such, virtual event system 200 may implement a feedback loop, wherein users listening to the virtual sporting event create interactive audio, which is then transmitted to the users in real-time or near real-time. However, in some embodiments, an audience member may choose not to receive interactive audio. In yet further embodiments, audience members may personalize and select portions of interactive audio to receive.

At step 740, personalized interactive audio content is generated. In some embodiments, a personalized audio component may be generated based on various personalization characteristics (e.g., friends, similar fans, users on the same freeway or in proximity to each other) and/or personalized audio input. The personalized audio component is added to the interactive audio content (which combines non-interactive audio component and interactive audio component) to create the personalized interactive audio content. During this process, the interactive audio content may be modified or muted. For example, a user may select to only receive audio input generated by other users supporting the same team. In another example, a user may select to only receive audio input generated by a group of other users selected by the user. Such personalized interactive audio content is then transmitted at step 745, such as via the delivery module.

Manipulation of Virtual Event Outcomes

Figure 8:
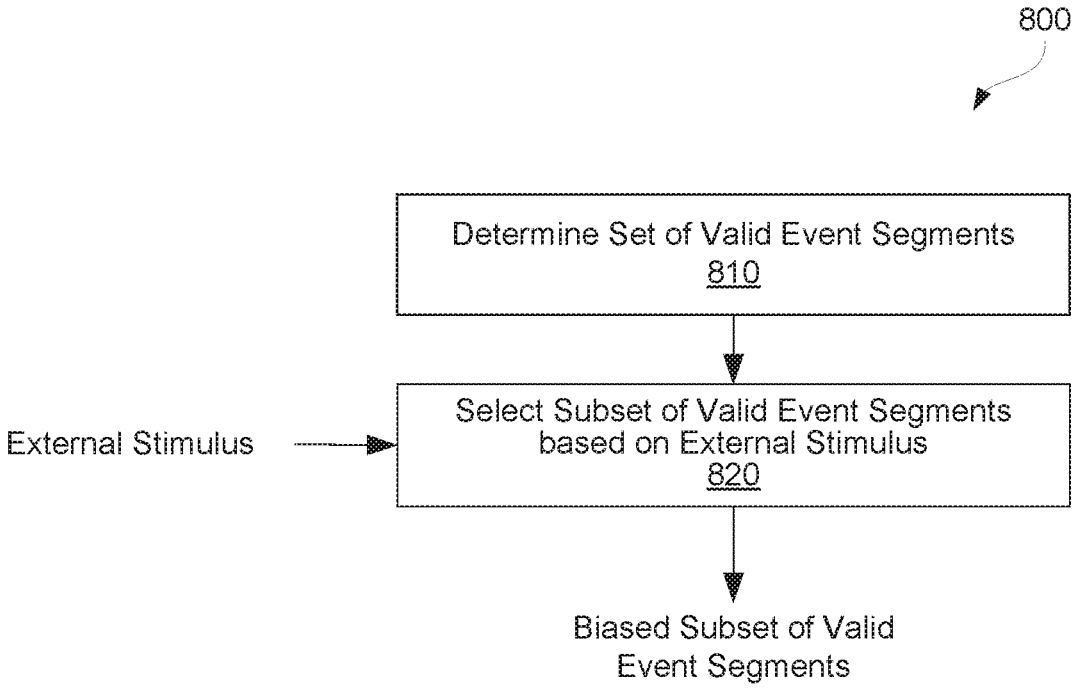
FIG. 8, shown is an example process for manipulating selection of event segments based on audience input, in accordance with one or more embodiments.

In some embodiments, input from client devices may also be used by virtual event system 200 for controlling or changing the outcome of the virtual sporting events. Such input, or external stimulus, may be used to alter the selection of event segments used for one or more time positions of the virtual event. The external stimulus may be applied before the start of the virtual sporting event or during the virtual sporting event. With reference to FIG. 8, shown is an example process 800 for manipulating selection of event segments based on audience input, in accordance with one or more embodiments.

At step 810, a set of valid event segments is determined, such as described with reference to operation 402 in method 400. External stimulus received from various user devices corresponding to audience members may then be received at system 200 and used to select a subset of valid event segments at step 820. The external stimulus may indicate a desired outcome for the particular time segment of the virtual sporting event. The subset of valid event segments may be biased based on the desired outcome.

In some embodiments, such biasing of selected event segments may be implemented in conjunction with, or as part of, an Interactive Play method, such as method 600-C, for selection of event segments. For example, audience members may be directed to provide user input to increase the chances of a successful play to be selected for a particular event segment. In some embodiments, if the amount of user input exceeds a predetermined threshold, the segment selection module may bias the segment selection by increasing the ratio of successful plays to unsuccessful plays. As such, there would be a greater chance that a successful play is selected.

As another example, a coin flip at the start of a virtual football game may be affected by user input. Typically the odds of the coin landing on heads would be 50%. However, user input may affect the segment selection module choice to selecting a resulting heads flip 60% of the time. This may provide incentive for listening users to participate and provide user input to obtain higher odds for their desired outcome.

Examples of external stimulus may include:

1) wagering (i.e. the more wagered on heads or tails the better the odds)

2) total number of current spectators (i.e. the more fans of heads or tails watching the game the better the odds)
3) a number of current spectators from a current location (i.e. the more fans from a specific city)
4) the loudest cheering fans (when a device is being used for audio input)
5) a number of current spectators with a connection to an advertising partner (i.e. number of fans driving a Chevrolet)
6) a number of current spectators who post on social media (i.e. number of fans who have tweeted) . . . .

Example Systems

Figure 9:
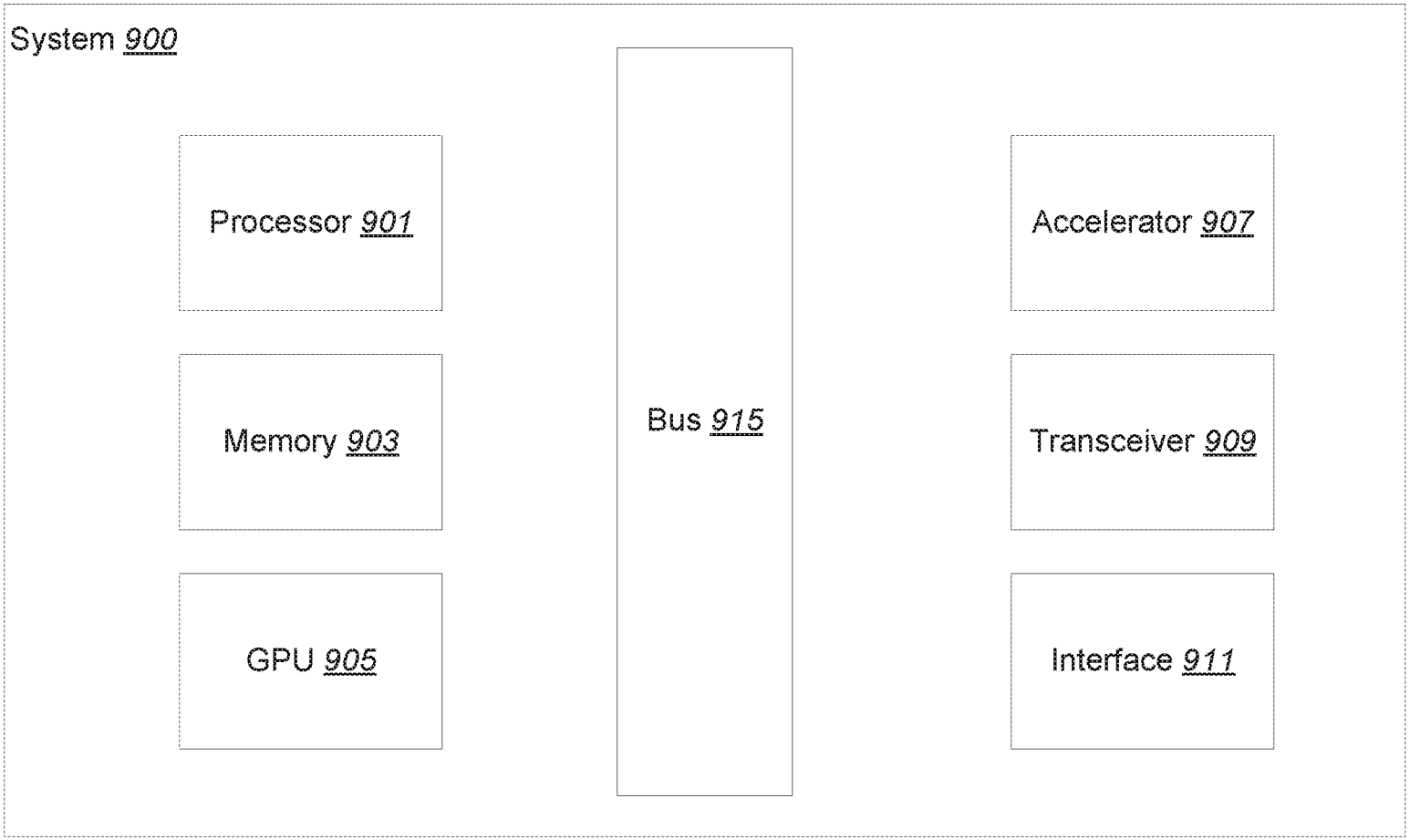
FIG. 9 illustrates a particular example of a computer system that can be used with various embodiments of the present disclosure.

Various computing devices can implement the methods described herein. For instance, a mobile device, computer system, etc. can be used to generate dynamic ETA predictive updates. With reference to FIG. 9, shown is a particular example of a computer system 900 that can be used to implement particular examples of the present disclosure. According to particular example embodiments, a system 900 suitable for implementing particular embodiments of the present disclosure includes a processor 901, a memory 903, a transceiver 909, an interface 911, and a bus 915 (e.g., a PCI bus). When acting under the control of appropriate software or firmware, the processor 901 is responsible for processing inputs through various computational layers and algorithms in a neural network. In some embodiments, the processor is responsible for updating the parameters of each computational layer using algorithms, including but not limited to, a stochastic gradient descent algorithm and a back propagation algorithm. Various specially configured devices can also be used in place of a processor 901 or in addition to processor 901. The complete implementation can also be done in custom hardware.

The interface 911 is typically configured to send and receive data packets or data segments over a network. Particular examples of interfaces the device supports include Ethernet interfaces, frame relay interfaces, cable interfaces, DSL interfaces, token ring interfaces, and the like. The interface 911 may include separate input and output interfaces, or may be a unified interface supporting both operations. In addition, various very high-speed interfaces may be provided such as fast Ethernet interfaces, Gigabit Ethernet interfaces, ATM interfaces, HSSI interfaces, POS interfaces, FDDI interfaces and the like. Generally, these interfaces may include ports appropriate for communication with the appropriate media. In some cases, they may also include an independent processor and, in some instances, volatile RAM. The independent processors may control such communications intensive tasks as packet switching, media control and management.

Transceiver 909 is typically a combination transmitter/receiver device. However system 900 may include a transmitter and a receiver as separate components in some embodiments. Transceiver 909 may be configured to transmit and/or receive various wireless signals, including Wi-Fi, Bluetooth, etc. In some embodiments, system 900 may function as a client device or location sensor or beacon to track location of an individual via wireless signals. The connection or communication between a client device and a beacon may indicate the presence of the corresponding individual in a particular location. In various embodiments, transceiver 909 may operate in a half duplex or full duplex mode. Various protocols could be used including various flavors of Bluetooth, Wi-Fi, light of sight transmission mechanisms, passive and active RFID signals, cellular data, mobile-satellite communications, as well as LPWAN, GPS, and other networking protocols. According to various embodiments, the transceiver may operate as a Bluetooth or Wi-Fi booster or repeater.

According to particular example embodiments, the system 900 uses memory 903 to store data and program instructions for operations including processing video and audio data or files. Such operations may also include training a neural network and generating event segment predictions, such as described in method 400 and methods 600-A, 600-B, 600-C, and/or 600-D. The program instructions may control the operation of an operating system and/or one or more applications, for example. The memory or memories may also be configured to store received metadata and batch requested metadata. The memory or memories may also be configured to store data corresponding to parameters and weighted factors.

In some embodiments, system 900 further comprises a graphics processing unit (GPU) 905. The GPU 905 may be implemented to process video and images of original content data, such as at operations 304, 306, 310, 312, 314, and 408 among others. In some embodiments, system 900 further comprises an accelerator 907. In various embodiments, accelerator 907 is a rendering accelerator chip, which may be separate from the graphics processing unit. Accelerator 907 may be configured to speed up the processing for the overall system 900 by processing pixels in parallel to prevent overloading of the system 900. For example, in certain instances, ultra-high-definition images may be processed, which include many pixels, such as DCI 4K or UHD-1 resolution. In such instances, excess pixels may be more than can be processed on a standard GPU processor, such as GPU 905. In some embodiments, accelerator 907 may only be utilized when high system loads are anticipated or detected.

In some embodiments, accelerator 907 may be a hardware accelerator in a separate unit from the CPU, such as processor 901. Accelerator 907 may enable automatic parallelization capabilities in order to utilize multiple processors simultaneously in a shared memory multiprocessor machine. The core of accelerator 907 architecture may be a hybrid design employing fixed-function units where the operations are very well defined and programmable units where flexibility is needed. In various embodiments, accelerator 907 may be configured to accommodate higher performance and extensions in APIs, particularly OpenGL 2 and DX9.

Because such information and program instructions may be employed to implement the systems/methods described herein, the present disclosure relates to tangible, machine readable media that include program instructions, state information, etc. for performing various operations described herein. Examples of machine-readable media include hard disks, floppy disks, magnetic tape, optical media such as CD-ROM disks and DVDs; magneto-optical media such as optical disks, and hardware devices that are specially configured to store and perform program instructions, such as read-only memory devices (ROM) and programmable read-only memory devices (PROMs). Examples of program instructions include both machine code, such as produced by a compiler, and files containing higher level code that may be executed by the computer using an interpreter.

CONCLUSION

Although many of the components and processes are described above in the singular for convenience, it will be appreciated by one of skill in the art that multiple components and repeated processes can also be used to practice the techniques of the present disclosure.

While the present disclosure has been particularly shown and described with reference to specific embodiments thereof, it will be understood by those skilled in the art that changes in the form and details of the disclosed embodiments may be made without departing from the spirit or scope of the disclosure. It is therefore intended that the disclosure be interpreted to include all variations and equivalents that fall within the true spirit and scope of the present disclosure.

What is claimed is:

1. A method for generating a virtual sporting event, the method comprising:

obtaining reference content data from a content database, wherein the reference content data comprises reference video, reference audio, and reference statistics of a plurality of original sporting events, wherein the reference audio and the reference statistics correspond to the reference video;

segmenting the reference content data into a plurality of event segments, wherein the plurality of event segments is identified based on one or more predefined milestones and comprises corresponding video data segments from the reference video, audio data segments from the reference audio, and statistical play data from the reference statistics, wherein the one or more predefined milestones are identified based on graphical information displayed in the reference video;

classifying each event segment with one or more categories based on a portion of reference content data corresponding to the respective event segment;

storing event segment information in a segments database, the event segment information comprising at least identification of one or more event segments;

selecting one or more event segments from the segment database as virtual event segments for each time segment of the virtual sporting event;

mapping virtual event data to each of the virtual event segments, wherein the virtual event data comprises one or more selected from the group consisting of: virtual event audio and fictional character information; and generating virtual event information for the virtual sporting event based on the mapped virtual event data and a progress of the virtual sporting event indicated by the virtual event segments.

2. The method of claim 1, wherein classifying the event segments with one or more categories includes, for each event segment, assigning tags to the event segments based on one or more of the following:

a type of play included in the event segment, a crowd sentiment based on the reference audio associated with the event segment, success of a play included in the event segment, and one or more players involved in a play included in the event segment.

3. The method of claim 1, wherein selecting the one or more event segments from the segment database as virtual event segments for each time segment of the virtual sporting event comprises:

receiving historical play data corresponding one or more historical sporting events;

determining probabilities of occurrence for different play types at different progress points based on the historical play data; and for each time segment, determining current virtual event information based on virtual event segments selected for previous time segments, identifying a set of valid event segments based on the current virtual event information, and selecting a new event segment of the set of valid event segments as the virtual event segment for the time segment based on the probabilities of occurrence, wherein the new event segment includes a category corresponding to a play type of the different play type.

4. The method of claim 1, wherein selecting one or more event segments from the segment database as a virtual event segment for each time segment of the virtual sporting event comprises:

receiving a programmed objective, wherein the programmed objective includes one or more predetermined conditions;

determining current virtual event information based on virtual event segments selected for previous time segments; and for each time segment, identifying a set of valid event segments based on the current virtual event information, determining if the predetermined condition is satisfied, and if the predetermined condition is satisfied, selecting a new event segment of the set of valid event segments as the virtual event segment based the programmed objective, wherein the new event segment includes a category that satisfies the programmed objective.

5. The method of claim 1, wherein selecting one or more event segments from the segment database as a virtual event segment for each time segment of the virtual sporting event comprises:

generating a set of complete virtual sporting events, wherein each complete sporting event comprises a possible combination of event segments;

selecting a first complete virtual sporting event from the set of complete virtual sporting events; and selecting the one or more event segments corresponding to the first complete virtual sporting event.

6. The method of claim 1, further comprising:

displaying the desensitized virtual event segments in conjunction with associated virtual event data and virtual event information;

obtaining narrative audio corresponding to the desensitized virtual event segments and corresponding virtual event data; and creating a virtual event audio file, the virtual event audio file including non-interactive audio including the narrative audio and corresponding virtual event audio.

7. The method of claim 6, further comprising:

transmitting the virtual event audio file to a plurality of client devices associated with a plurality of audience members.

8. The method of claim 7, wherein transmitting the virtual event audio file comprises transmitting the virtual event audio file via a network.

9. The method of claim 7, wherein selecting one or more event segments from the segment database as a virtual event segment for each time segment of the virtual sporting event comprises:

obtaining audience feedback data from the plurality of client devices associated with the plurality of audience members, wherein the audience feedback data indicates a desired category; and selecting an event segment including a category corresponding to the desired category.

10. A programmable device configured for generating a virtual sporting event, wherein the programmable device is configured for:

obtaining reference content data from a content database, wherein the reference content data comprises reference video, reference audio, and reference statistics of a plurality of original sporting events, wherein the reference audio and the reference statistics correspond to the reference video;

segmenting the reference content data into a plurality of event segments, wherein the plurality of event segments is identified based on one or more predefined milestones and comprises corresponding video data segments from the reference video, audio data segments from the reference audio, and statistical play data from the reference statistics, wherein the one or more predefined milestones are identified based on graphical information displayed in the reference video;

classifying each event segment with one or more categories based on a portion of reference content data corresponding to the respective event segment;

storing event segment information in a segments database, the event segment information comprising at least identification of one or more event segments;

selecting one or more event segments from the segment database as a virtual event segment for each time segment of the virtual sporting event;

mapping virtual event data to each of the virtual event segments, wherein the virtual event data comprises one or more selected from the group consisting of: virtual event audio and fictional character information; and generating virtual event information for the virtual sporting event based on the mapped virtual event data and a progress of the virtual sporting event indicated by the virtual event segments.

11. The programmable device of claim 10, wherein classifying the event segments with one or more categories includes, for each event segment, assigning tags to the event segments based on one or more of the following:

a type of play included in the event segment, a crowd sentiment based on the reference audio associated with the event segment, success of a play included in the event segment, and one or more players involved in a play included in the event segment.

12. The programmable device of claim 10, wherein selecting one or more event segments from the segment database as a virtual event segment for each time segment of the virtual sporting event comprises:

receiving historical play data corresponding one or more historical sporting events;

determining probabilities of occurrence for different play types at different progress points based on the historical play data; and for each time segment, determining current virtual event information based on virtual event segments selected for previous time segments, identifying a set of valid event segments based on the current virtual event information, and selecting a new event segment of the set of valid event segments as the virtual event segment for the time segment based on the probabilities of occurrence, wherein the new event segment includes a category corresponding to a play type of the different play type.

13. The programmable device of claim 10, wherein selecting one or more event segments from the segment database as a virtual event segment for each time segment of the virtual sporting event comprises:

receiving a programmed objective, wherein the programmed objective includes one or more predetermined conditions;

determining current virtual event information based on virtual event segments selected for previous time segments; and for each time segment, identifying a set of valid event segments based on the current virtual event information, determining if the predetermined condition is satisfied, and if the predetermined condition is satisfied, selecting a new event segment of the set of valid event segments as the virtual event segment based the programmed objective, wherein the new event segment includes a category that satisfies the programmed objective.

14. The programmable device of claim 10, wherein selecting one or more event segments from the segment database as a virtual event segment for each time segment of the virtual sporting event comprises:

generating a set of complete virtual sporting events, wherein each complete sporting event comprises a possible combination of event segments;

selecting a first complete virtual sporting event from the set of complete virtual sporting events; and selecting the one or more event segments corresponding to the first complete virtual sporting event.

15. The programmable device of claim 10, wherein the programmable device is further configured for:

displaying the desensitized virtual event segments in conjunction with associated virtual event data and virtual event information;

obtaining narrative audio corresponding to the desensitized virtual event segments and corresponding virtual event data; and creating a virtual event audio file, the virtual event audio file including non-interactive audio including the narrative audio and corresponding virtual event audio.

16. The programmable device of claim 15, wherein the programmable device is further configured for:

transmitting the virtual event audio file to a plurality of client devices associated with a plurality of audience members.

17. The programmable device of claim 16, wherein selecting one or more event segments from the segment database as a virtual event segment for each time segment of the virtual sporting event comprises:

obtaining audience feedback data from the plurality of client devices associated with the plurality of audience members, wherein the audience feedback data indicates a desired category; and selecting an event segment including a category corresponding to the desired category.

18. A server system configured to generate a virtual sporting event, the server system comprising: one or more processors, memory, and one or more programs stored in the memory, the one or more programs comprising instructions for:

obtaining reference content data from a content database, wherein the reference content data comprises reference video, reference audio, and reference statistics of a plurality of original sporting events, wherein the reference audio and the reference statistics correspond to the reference video;

segmenting the reference content data into a plurality of event segments, wherein the plurality of event segments is identified based on one or more predefined milestones and comprises corresponding video data segments from the reference video, audio data segments from the reference audio, and statistical play data from the reference statistics, wherein the one or more predefined milestones are identified based on graphical information displayed in the reference video;

classifying each event segment with one or more categories based on a portion of reference content data corresponding to the respective event segment;

storing event segment information in a segments database, the event segment information comprising at least identification of one or more event segments;

selecting one or more event segments from the segment database as a virtual event segment for each time segment of the virtual sporting event;

mapping virtual event data to each of the virtual event segments, wherein the virtual event data comprises one or more selected from the group consisting of: virtual event audio and fictional character information; and generating virtual event information for the virtual sporting event based on the mapped virtual event data and a progress of the virtual sporting event indicated by the virtual event segments.

* * * * *